US009200794B2

(12) United States Patent
Clifford

(10) Patent No.: US 9,200,794 B2
(45) Date of Patent: Dec. 1, 2015

(54) FAN COOLED LED LIGHT AND HOUSING

(71) Applicant: LEDLab, LLC, Mesa, AZ (US)

(72) Inventor: Scott Clifford, Mesa, AZ (US)

(73) Assignee: LEDLab, LLC, Mesa, AZ (US)

( * ) Notice: Subject to any disclaimer, the term of this patent is extended or adjusted under 35 U.S.C. 154(b) by 0 days.

(21) Appl. No.: 14/454,462

(22) Filed: Aug. 7, 2014

(65) Prior Publication Data

US 2014/0354155 A1 Dec. 4, 2014

Related U.S. Application Data

(63) Continuation of application No. 14/327,341, filed on Jul. 9, 2014, which is a continuation-in-part of application No. 13/938,093, filed on Jul. 9, 2013, which is a continuation-in-part of application No. 13/908,690, filed on Jun. 3, 2013.

(51) Int. Cl.

| | |
|---|---|
| ***F21V 29/02*** | (2006.01) |
| ***F21V 29/70*** | (2015.01) |
| *F21K 99/00* | (2010.01) |
| *F21Y 101/02* | (2006.01) |
| *F21V 29/507* | (2015.01) |
| *F21V 29/83* | (2015.01) |

(52) U.S. Cl.

CPC . *F21V 29/02* (2013.01); *F21K 9/13* (2013.01); *F21K 9/90* (2013.01); *F21V 29/507* (2015.01); *F21V 29/83* (2015.01); *F21Y 2101/02* (2013.01); *Y10T 29/49117* (2015.01)

(58) Field of Classification Search

CPC ..... H01J 61/52; F21V 29/00; F21V 29/02; F21V 29/22; F21V 29/025; F21V 29/027; F21V 29/2293; F24F 3/056; F24F 13/078; G03B 21/16; F21K 9/135; H05B 33/00

USPC ..... 315/112–113, 117; 362/218, 264, 294, 362/345, 373

See application file for complete search history.

(56) References Cited

U.S. PATENT DOCUMENTS

| | | | |
|---|---|---|---|
| 7,081,722 | B1 | 7/2006 | Huynh et al. |
| 7,196,580 | B2 | 3/2007 | Ryoo et al. |
| 7,313,244 | B2 | 12/2007 | Ryoo et al. |
| 7,436,042 | B2 | 10/2008 | Ryoo et al. |

(Continued)

FOREIGN PATENT DOCUMENTS

| | | | |
|---|---|---|---|
| GB | 2420172 | A | 5/2006 |
| JP | 2012252891 | A | 12/2012 |

(Continued)

*Primary Examiner* — Tuyet Vo
*Assistant Examiner* — Henry Luong
(74) *Attorney, Agent, or Firm* — Booth Udall Fuller, PLC

(57) ABSTRACT

A light emitting diode (LED) system that includes a LED, a heat sink, a fan housing, a fan, and a cover is disclosed. The heat sink is typically coupled to the LED, and the fan housing is typically coupled to the heat sink opposite the LED. The fan housing is sized to fit within an electrical junction box and includes a fan housing aperture that extends through the fan housing. A cover may be coupled to the fan housing opposite the heat sink. The system may include at least one air intake opening and at least one air exhaust opening. When activated, the fan may external air into the fan housing through the air intake opening and direct the air toward the heat sink and ultimately through the air exhaust opening. In so doing, the temperature of the heat sink and the LED is reduced.

23 Claims, 30 Drawing Sheets

(56) References Cited

U.S. PATENT DOCUMENTS

| | | | | |
|---|---|---|---|---|
| 7,439,944 | B2 | 10/2008 | Huynh et al. | |
| 8,123,381 | B1 * | 2/2012 | Wray | 362/294 |
| 8,319,408 | B1 | 11/2012 | Horng | |
| 8,324,823 | B2 | 12/2012 | Choi et al. | |
| 2011/0013383 | A1 | 1/2011 | Medinis | |
| 2011/0170287 | A1 | 7/2011 | Medinis | |
| 2011/0215698 | A1 | 9/2011 | Tong et al. | |
| 2011/0273102 | A1 | 11/2011 | Van De Ven et al. | |
| 2012/0044642 | A1 | 2/2012 | Rodriguez | |
| 2012/0119647 | A1 | 5/2012 | Hsu | |
| 2012/0236576 | A1 | 9/2012 | Fang et al. | |
| 2012/0287651 | A1 | 11/2012 | Hirata | |
| 2012/0300475 | A1 | 11/2012 | Kim | |
| 2013/0026924 | A1 | 1/2013 | Jong et al. | |
| 2013/0094226 | A1 * | 4/2013 | Huang et al. | 362/373 |
| 2013/0114260 | A1 | 5/2013 | Lopez et al. | |
| 2013/0250578 | A1 * | 9/2013 | Lan | 362/294 |
| 2013/0294094 | A1 | 11/2013 | Horng | |

FOREIGN PATENT DOCUMENTS

| | | | |
|---|---|---|---|
| WO | WO 2012155816 | A1 * | 11/2012 |
| WO | 2012168845 | A1 | 12/2012 |

* cited by examiner

192

FAN COOLED LED LIGHT AND HOUSING

CROSS REFERENCE TO RELATED APPLICATIONS

This application is a continuation of U.S. patent application Ser. No. 14/327,341 entitled "FAN COOLED LED LIGHT AND HOUSING" to Clifford, which was filed on Jul. 9, 2014, now pending, which is a continuation-in-part of U.S. patent application Ser. No. 13/938,093 entitled "COMPACT LED DEVICE WITH COOLING FAN" to Clifford, which was filed on Jul. 9, 2013, which is a continuation-in-part application of U.S. patent application Ser. No. 13/908,690 entitled FAN COOLED LED LIGHT AND HOUSING" to Clifford, which was filed on Jun. 3, 2013, the contents of all of which hereby incorporated by this reference.

BACKGROUND

1. Technical Field

Aspects of this document relate generally to light emitting diode assemblies.

2. Background Art

Light-emitting diodes (LED) are becoming an increasingly popular light source. Generally, LEDs are advantageous to typical incandescent light sources due to LEDs' lower energy consumption, longer lifetime, smaller size, and faster switching. The efficiency and operational life of LEDs, however, is somewhat limited by the heat generated by LEDs with the LEDs activated.

SUMMARY

According to one aspect, a light emitting diode (LED) lighting system comprises one or more LEDs, a heat sink coupled to the one or more LEDs, a fan housing, and a fan. The heat sink comprises an outer periphery, a platform, a sink wall, and an air exhaust opening extending through the platform and positioned between the sink wall and the platform. The fan housing is coupled to the platform of the heat sink opposite the one or more LEDs and comprises an end wall positioned between the sink wall and the outer periphery of the heat sink, a dividing wall coupled to the end wall and comprising a terminating end aligned with and adjacent to the sink wall, an outer opening positioned between the end wall and the dividing wall, a fan housing aperture within the fan housing, and a cover coupled to the positioned opposite the heat sink. The fan coupled to the fan housing is positioned at least partially within the fan housing aperture, wherein airflow enters the fan housing through the outer opening, passes through the fan housing aperture to interface the heat sink, and exits through the air exhaust opening responsive to activation of the fan.

Various implementations and embodiments may comprise one or more of the following. The sink wall may comprise two sink walls, the air exhaust openings may comprise two air exhaust openings extending through the platform, each air exhaust opening positioned between a different sink wall and the platform, the end wall of the fan housing may comprise two opposing end walls each positioned between a different sink wall of the two sink walls and the nearest outer periphery of the heat sink, the fan housing further comprising two opposing sidewalls positioned between the two end walls. The dividing wall of the fan housing may comprise two opposing dividing walls each comprising a terminating end aligned with and adjacent to a different one of the two sink walls, the fan housing aperture being positioned between the two dividing walls. The outer opening may comprise two outer openings positioned between a different end wall of the two end walls and a different dividing wall of the two dividing walls. The fan housing may include a height in a range between 2.5-6.875 centimeters and include a volume small enough to be housed within a standard single gang electrical junction box. The heat sink may be configured to mount to a flat surface and the end walls, the sidewalls, and the dividing walls of the fan housing are integral with one another. The heat sink may further comprise an outer wall at the outer periphery, a heat sink channel formed between the outer wall and each of the heat sink walls, and a plurality of air intake openings extending through the outer wall. The plurality of air intake openings may be positioned within an angled portion of the outer wall and the heat sink further comprises a plurality of arced ribs extending from the platform toward the fan housing. A bulb-like housing coupled to the heat sink such that the fan housing is housed within the bulb-like housing, the bulb like housing comprising an open first end coupled to the heat sink and a second end coupled to a socket fitting operably coupled to the one or more LEDs and the fan, wherein, responsive to activation of the fan, air flows into the LED light system through the air intake openings, through the two outer openings, through the fan housing aperture, and out the air exhaust openings, each air exhaust opening being separated from the air intake openings by at least the respective sink wall. A mounting ring removably coupled to the heat sink, the mounting ring comprising one or more screw holes positioned to align with one or more screw mounts on a standard electrical junction box such that when the mounting ring is coupled to the standard electrical junction box, the fan housing is positioned within the standard electrical junction box and at least a portion of the mounting ring is adjacent a flat surface to which the standard electrical junction box is mounted. A plurality of spacing tabs on an inner surface of the sink between the heat sink and the mounting ring. An air intake opening formed between an outer surface of the mounting ring and the inner surface of the heat sink, wherein, responsive to activation of the fan, air flows into the LED light system through the air intake opening, through the two outer openings, through the fan housing aperture, and out the air exhaust openings. The mounting ring may be coupled to the heat sink with one or more biased mounting tabs and an outer periphery of the mounting ring is substantially aligned with the outer periphery of the heat sink. The lighting system may further comprise a semiconductor chip comprising an input coupled to an AC power supply and further comprising a plurality of DC power outputs, wherein the one or more LEDs comprises a plurality of banks of LEDs coupled to the plurality of DC power outputs, and wherein the fan is further coupled in parallel with a first of the plurality of banks of LEDs.

According to another aspect, a light emitting diode (LED) lighting system, comprises one or more LEDs, a heat sink coupled to the one or more LEDs, a mounting ring, a fan housing, and a fan. The heat sink comprises a platform, a sink wall, and an air exhaust opening heat sink. The mounting ring is coupled to the heat sink opposite the one or more LEDs, the mounting ring comprising one or more screw holes positioned to mount the LED lighting system to an electrical junction box mounted to a flat surface. The fan housing is coupled to the platform of the heat sink opposite the one or more LEDs and sized to fit within a single gang electrical junction box, the fan housing comprising an end wall, a dividing wall coupled to the end wall and comprising a terminating end aligned with and adjacent to the sink wall, an outer opening positioned between the end wall and the dividing wall, a fan housing aperture within the fan housing, and a cover opposite the heat sink. The fan is coupled to the fan housing and positioned at least partially within the fan housing aperture, wherein, responsive to activation of the fan, airflow enters the fan housing through the outer opening, passes through the fan housing aperture to interface with the heat sink, and the exits through the air exhaust opening of the heat sink.

Various implementations and embodiments may comprise one or more of the following. The sink wall may comprise two sink walls. The air exhaust openings may comprise two air exhaust openings extending through the platform, each air exhaust opening positioned between a different sink wall and the platform. The end wall of the fan housing may comprise two opposing end walls, the fan housing further comprising two opposing sidewalls positioned between the two end walls. The dividing wall of the fan housing may comprise two opposing dividing walls each comprising a terminating end aligned with and adjacent to a different one of the two sink walls, the fan housing aperture being positioned between the two dividing walls. The outer opening may comprise two outer openings positioned between a different end wall of the two end walls and a different dividing wall of the two dividing walls. The dividing walls, the end walls, and the sidewalls of the fan housing may be integral with one another. The heat sink may comprise an outer wall at an outer periphery, a heat sink channel formed between the outer wall and each of the heat sink walls, one or more screw holes, and a plurality of air intake openings extending through the outer wall. The plurality of air intake openings may be positioned within an angled portion of the outer wall and the heat sink may comprise a plurality of arced ribs extending from the platform toward the fan housing. A bulb-like housing coupled to the mounting ring such that the fan housing is housed within the bulb-like housing, the bulb like housing comprising an open end coupled to the heat sink and a closed end coupled to a socket fitting operably coupled to the one or more LEDs and the fan, wherein, responsive to activation of the fan, air flows into the LED light system through the air intake openings, through the two outer openings, through the fan housing aperture, and out the air exhaust openings, each air exhaust opening being separated from the air intake openings by at least the respective sink wall. A mounting ring removably coupled to the heat sink, the mounting box comprising one or more screw holes positioned to align with one or more screw mounts on a standard electrical junction box such that when the mounting ring is coupled to the standard electrical junction box, the fan housing is positioned within the standard electrical junction box and at least a portion of the mounting ring is adjacent a flat wall to which the standard electrical junction box is mounted. A plurality of spacing tabs on an inner surface of the sink between the heat sink and the mounting ring. An air intake opening formed between an outer surface of the mounting ring and the inner surface of the heat sink, wherein, responsive to activation of the fan, air flows into the LED light system through the air intake opening, through the two outer openings, through the fan housing aperture, and out the air exhaust openings. The mounting ring may be coupled to the heat sink with one or more biased mounting tabs and an outer periphery of the mounting ring is substantially aligned with the outer periphery of the heat sink. The lighting system may comprise a semiconductor chip comprising an input coupled to an AC power supply and further comprising a plurality of DC power outputs, wherein the one or more LEDs comprises a plurality of banks of LEDs coupled to the plurality of DC power outputs, and wherein the fan is further coupled in parallel with a first of the plurality of banks of LEDs.

According to another aspect, a light emitting diode (LED) lighting system comprises a heat sink, a fan housing, one or more LEDs, and a fan. The heat sink comprises a plurality of arced ribs extending from an outer periphery of the heat towards a center of the heat sink. The fan housing is coupled to the heat sink adjacent the plurality of arced ribs such that a plurality of air exhaust openings are formed on the outer periphery of the heat sink between the heat sink and a first end of the fan housing, the fan housing comprising a plurality of air intake openings on an outer periphery of the fan housing distal the air exhaust openings. The one or more LEDs are coupled to the heat sink opposite the fan housing. The fan is mounted within the fan housing, wherein, responsive to activation of the fan, air flows into the fan housing through the air intake openings and out the fan housing through the air exhaust openings.

Various implementations and embodiments may comprise one or more of the following. The plurality of air intake openings may be on an angled portion of the outer periphery of the fan housing. The heat sink may comprise a circular heat sink and the fan housing comprises a substantially cylindrical housing. A diameter of the heat sink may be substantially equal to a diameter of the first end of the fan housing. A plurality of coupling posts extending from the head sink and engaged with a plurality of tab receivers on the fan housing. A cover coupled to the second end of the housing. The cover may comprise a threaded coupling. The cover may be configured to mount to a flat surface having a mounting hole therein such that the heat sink is substantially parallel to the flat surface.

According to another aspect, a method of mounting a light emitting diode (LED) lighting system to a flat surface comprises inserting a fan housing of the LED lighting system into an electrical junction box adjacent the flat surface, the fan housing comprising an end wall, a dividing wall, an outer opening positioned between the end wall and the dividing wall, and a fan housing aperture within the fan housing with a fan mounted therein; and coupling a heat sink of the LED lighting system to the electrical junction box, the heat sink being coupled to the fan housing and comprising a platform adjacent the fan housing, a sink wall adjacent the dividing wall, and an air exhaust positioned on a side of the dividing wall opposite the outer opening such that, responsive to activation of the fan, air flows into the housing through outer opening, through the fan housing aperture, and out of the LED lighting system through the air exhaust opening.

Various implementations and embodiments may comprise one or more of the following. Coupling a mounting ring to the electrical junction box. Coupling the heat sink to the electrical junction box may comprise coupling the heat sink to the mounting ring coupled to the electrical junction box. Transmitting AC power to a semiconductor chip of the LED lighting system, transmitting DC power from the semiconductor chip to a first bank of LEDs and not a second bank of LEDs, transmitting DC power from the semiconductor chip to the second bank of LEDs and not the first bank of LEDs, and operating the fan at a speed proportional to a brightness of the first and second banks of LEDs. Operating the fan by transmitting DC power from the semiconductor chip through the first bank of LEDs to the fan. Operating the fan by transmitting DC power from the first bank of LEDs through a filter to the fan.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The invention will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended light emitting diode (LED) cooling system and/or assembly procedures for a LED cooling system will become apparent for use with implementations of LED cooling systems from this disclosure. Accordingly, for example, although particular LEDs, heat sinks, fan housings, covers, boxes, adapters, and the like are disclosed, such LEDs, heat sinks, fan housings, covers, boxes, and adapters and implementing components may comprise any shape, size, style, type, model, version, measurement, concentration, material, quantity, and/or the like as is known in the art for such LED cooling assemblies and implementing components, consistent with the intended operation of an LED cooling assembly.

LEDs are source of light gaining popularity throughout the country and the world largely due to the LED typically consuming less energy and lasting longer. While some LEDs may also manage heat better than previous sources of light, it is well known that previous LEDs still become hot, thus lessening efficiency or resulting in a safety hazard. Embodiments of the cooling systems and assemblies disclosed herein provide a fan 7 to assist in cooling the LED, as well as configurations for efficient cool of the LED and elements associated with the LED assembly.

Figure 1:
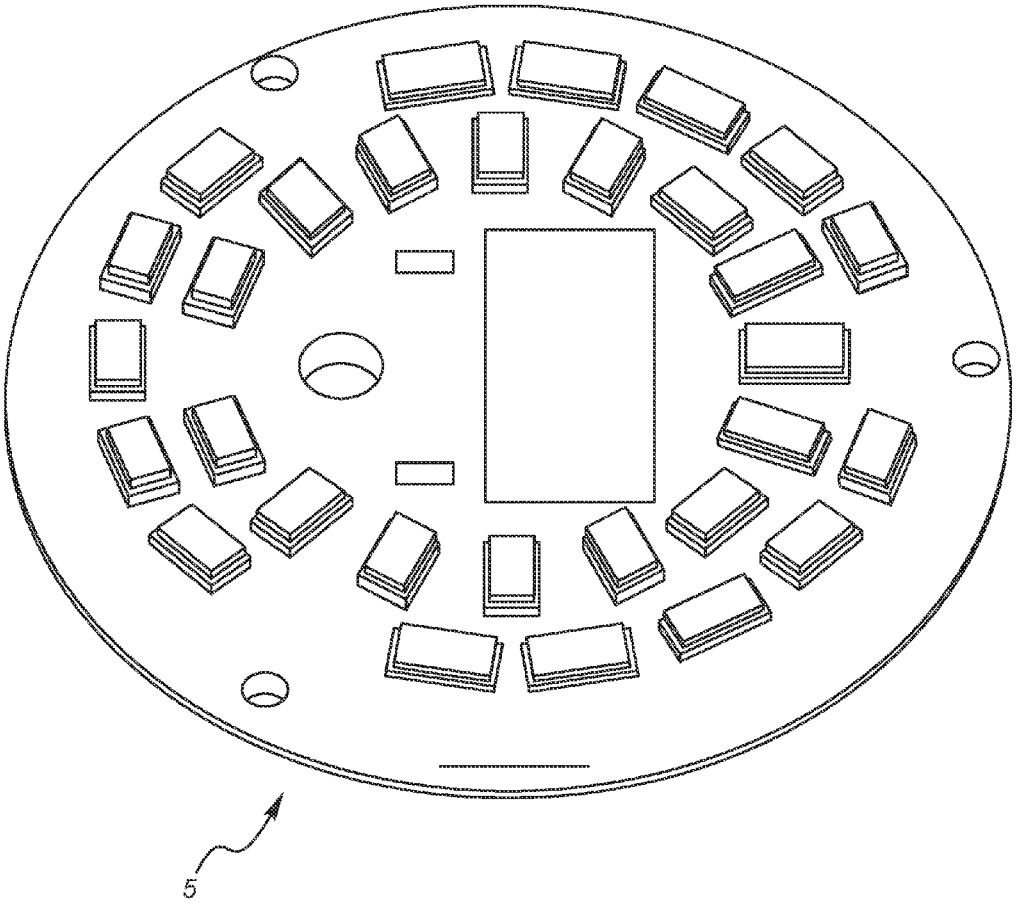
FIG. 1 is a perspective view of an exemplary light emitting diode (LED) circuit.

One of more embodiments of a LED cooling system 100, 200 comprise an LED 5. FIG. 1 illustrates exemplary an embodiment of an LED 5 utilized in a LED cooling system 100, 200, the LED 5 requiring a 120 volt or appropriate input. It is contemplated, however, that in other embodiments, any LED known in the art may be substituted or modified for use in embodiments of an LED cooling system 100 disclosed herein.

Figure 2:
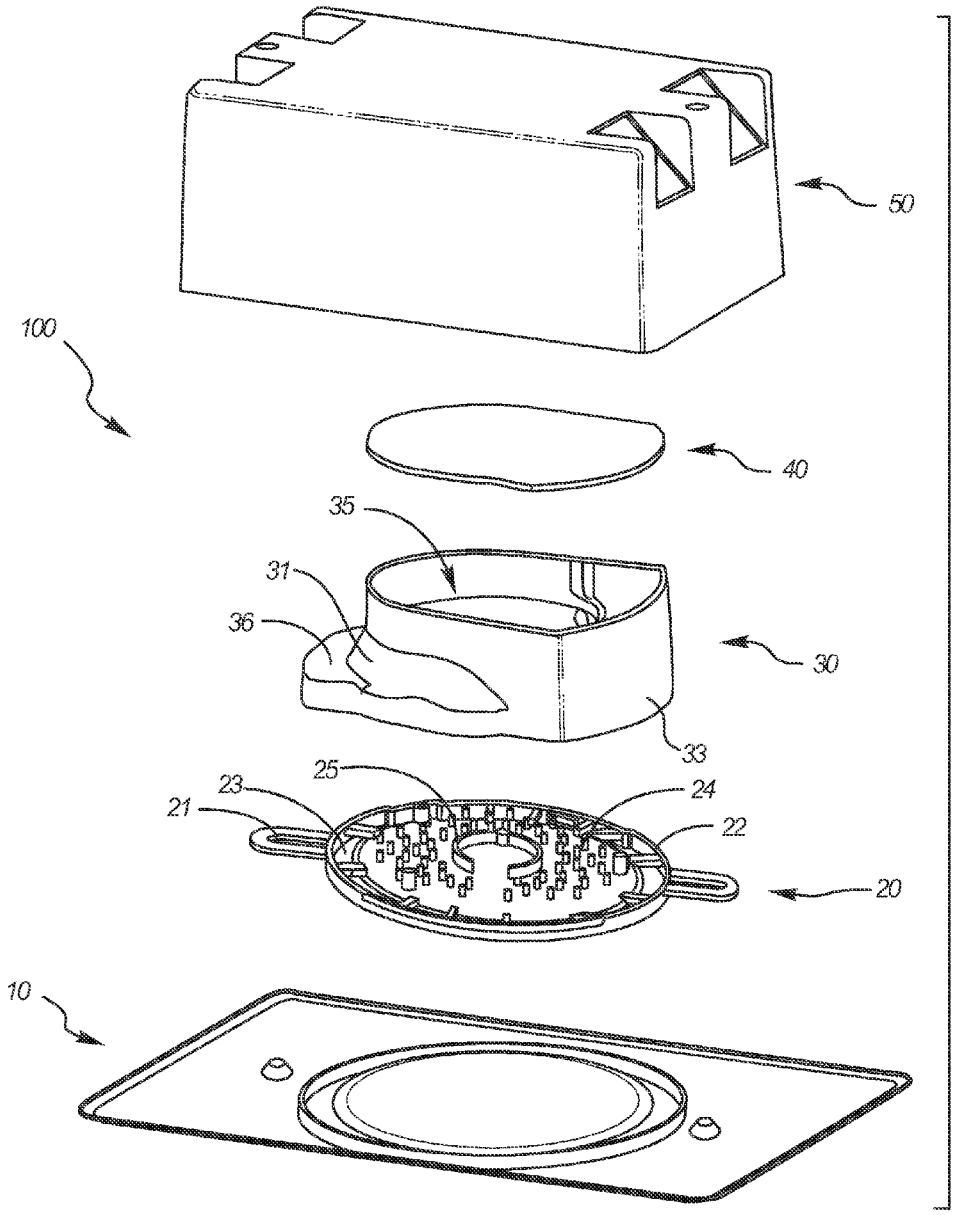
FIG. 2 is a break apart view of a first embodiment of a LED cooling system.

FIG. 2 illustrates an exploded perspective view of one exemplary embodiment of a LED cooling system comprising an cover plate 10 that includes LED 5, a heat sink 20, a fan housing 30, a cover 40, and an electrical junction box 50 (sometimes called a J-Box in the relevant industry). In some applications of the various embodiments shown herein, the electrical junction box 50 may or may not be used, and, alternatively, the housing 30 and/or cover 40 may not be used. Electrical junction boxes 50, come in standard depths including, but not limited to, 1", 2" and 3". In particular implementations, the LED 5, heat sink 20, fan housing 30 and cover 40 may all fit within even a 1" electrical junction box 50. Although not shown in FIG. 2, a fan 7 may also be nesting at least partially within the fan housing 30. As shown in greater detail in FIG. 3, a particular embodiment of the heat sink 20 is substantially circular in shape. Other embodiments of the heat sink 20, however, may comprise other shapes to correspond to the shape of the fan housing 30, as shall be described.

Figure 4:
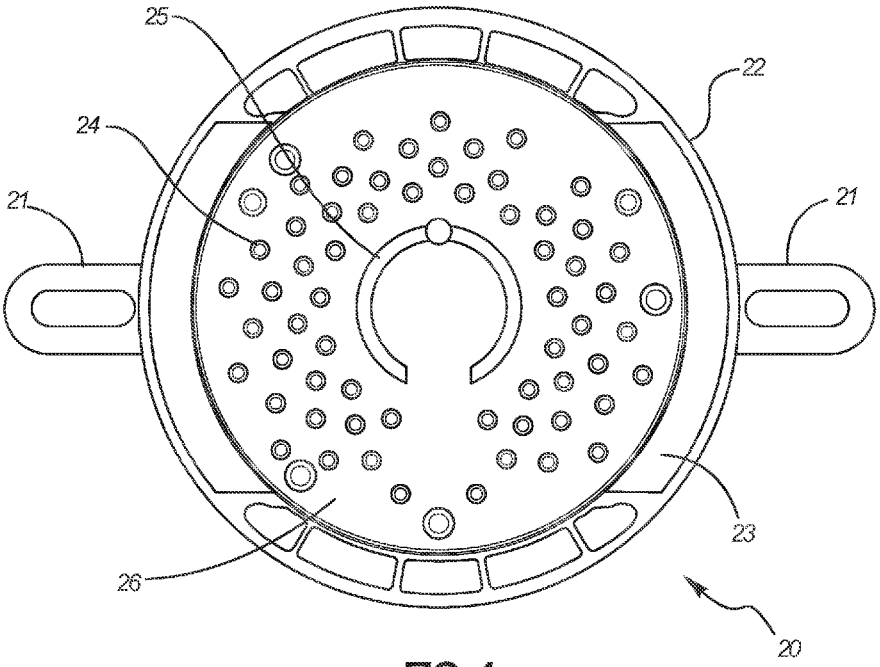
FIG. 4 is a top view of a first embodiment of a heat sink.

One or more embodiments of the heat sink 20 comprise a circular platform 26 at least partially surrounded by an annular opening 23. In embodiments wherein the platform 26 comprises a non-circular shape, the annular opening 23 comprises a shape corresponding to the shape of the platform 26. Embodiments of the platform 26 comprise one or more dividers 24 or spacers. The dividers 24 typically comprise posts or other protrusions extending from one side of the platform 26. Ideally, the dividers 24 may be positioned to assist in distributing airflow from the fan 7 in a substantially uniform manner, thus improving heat dissipation. FIG. 4 illustrates one exemplary arrangement of the dividers 24 on the platform 26. It should be recognized that other embodiments of the heat sink 20 may comprise fewer or greater dividers 24 positioned in other arrangements without departing from the scope of this disclosure. One or more embodiments of the heat sink 20 further comprise a raised center lip 25 or member which may provide support or positioning for the fan 7. In other embodiments, a thermal switch may replace the raised center lip 25.

One or more embodiments of the heat sink 20 also comprise a sink wall 22 positioned about the platform 26. The annular opening 23 typically separates at least a portion or all of the platform 26 from the sink wall 22. In embodiments wherein the annular opening 23 separates the platform from the sink wall 22, one or more connectors may bridge across the annular opening to couple the platform 26 to the sink wall 22. One or more embodiments also may comprise at least one fastener mount 21, typically positioned as two opposing fastener mounts extending from opposing sides of the sink wall 22. In other embodiments, the fastener mounts may be positioned on or extend from the platform 26.

Figure 5A:
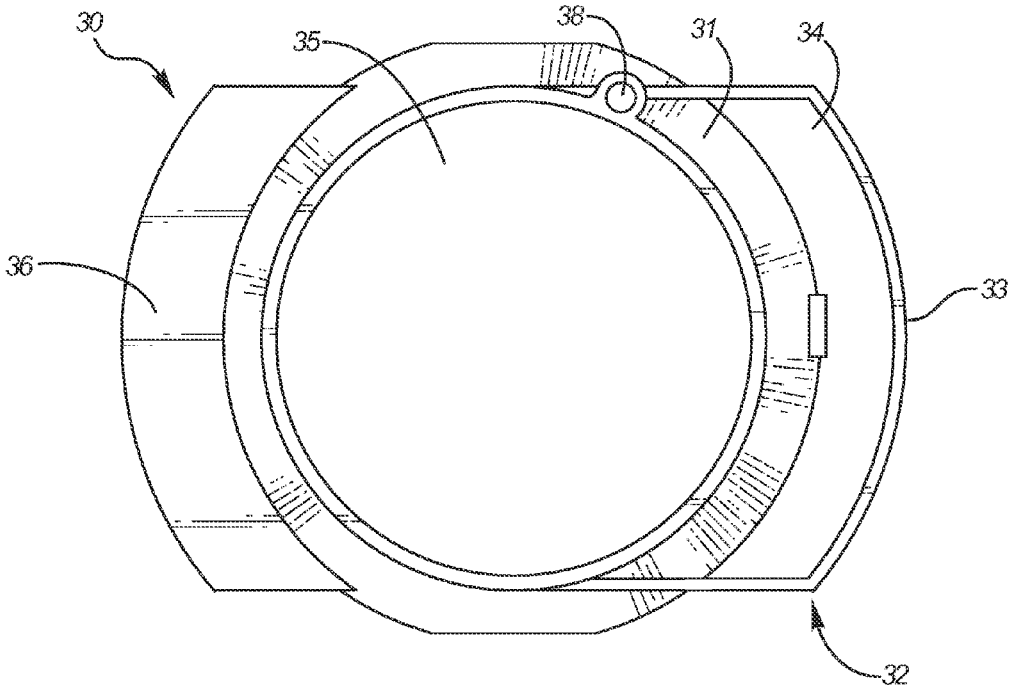
FIG. 5A a top view of a first embodiment of a fan housing.
Figure 5B:
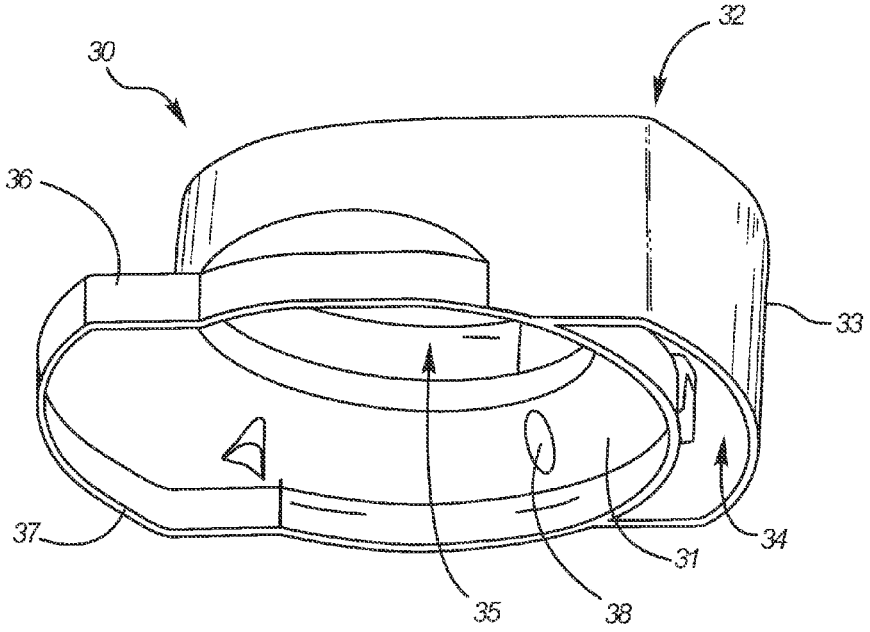
FIG. 5B is a bottom perspective view of a first embodiment of a fan housing.

FIGS. 5A and 5B illustrate an embodiment of a fan housing 30. At least a portion of the fan housing 30 is typically shaped to complement at least a portion of the heat sink 20. For example, in the embodiment of the fan housing 30 illustrated in FIGS. 5A and 5B, the fan housing 30 comprises a substantially conical sloped body 31 with a based sized equal or substantially equal to the platform 26. In some embodiments, the base of the sloped body 31 may be sized equal or substantially equal to the sink wall 22 to provide different air intakes. Although the sloped body 31 is shown as a conical sloped body 31 in FIGS. 5A and 5B, other shaped sloped bodies are also contemplated, such as but not limited to a pyramid sloped body.

One or more embodiments of a fan housing 30 also comprise a fan housing wall 32. The fan housing wall 32 typically comprises at least one convex portion. In the embodiment shown in FIG. 5B, the fan housing wall 32 comprises an open convex portion 33 separated at least partially from the sloped body 31 by an outer opening 34. Opposite the open convex portion 33 is an enclosed convex portion 36. The enclosed convex portion 36 may comprise a height substantially equally to the height of the open convex portion 33 or alternatively, as shown in the exemplary embodiment of FIG. 5B, a height substantially equal to a base rim 37 extending from a portion of a base end of the sloped body 31. In the latter, the fan housing wall 32 may comprise a convex portion 33 and a U-shaped portion. In other embodiments, the convex portion may comprise a flat portion that still provides and outer opening 34 between the wall 33 and the sloped body.

The fan housing 30 further comprises a fan housing aperture 35 extending through the fan housing 30. The fan housing aperture 35 is in fluid communication with the outer opening 34, even when the cover 40 is coupled to a top end of the fan housing 30. As such, the fan housing wall 32 typically comprises a height greater than the height of the sloped body 31 within the fan housing 30. In one or more embodiments, the fan housing aperture 35 is at least partially formed by the boundaries of the sloped body 31 and the base rim 37. A wire hole 38 is also positioned to extending through a portion of the sloped body 31 in one or more embodiments.

Figure 3:
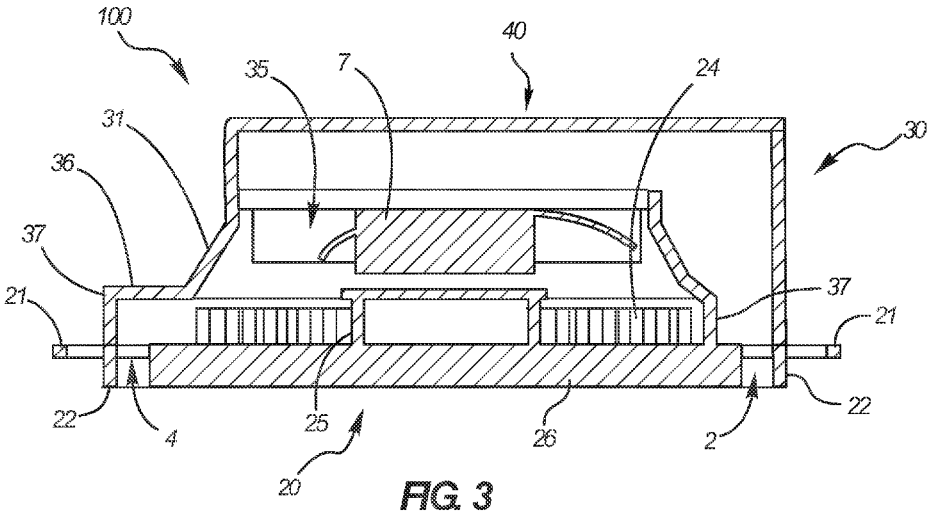
FIG. 3 is a cross sectional view of a first embodiment of a LED cooling system.

FIG. 3 illustrates a cross-sectioned view of an embodiment of a portion of an LED cooling system 100. Although not shown in FIG. 3, the LED 5 and/or cover plate 10 are typically positioned or coupled beneath the platform 26. As shown, portions of the fan housing 30 and the heat sink 20 abut one another when coupled together. For example, the open convex portion 33 of the fan housing wall 32 typically abuts a portion of the sink wall 22, and a portion of the enclosed convex portion 36 abuts another portion of the sink wall 22. When coupled in such an alignment, the outer opening 34 aligns with and is in fluid communication with a first portion of the annular opening 23, and the chamber or opening within the enclosed convex portion 36 aligns with and is in fluid communication with a second portion of the annular opening 23. A cover 40 is typically coupled to the fan housing wall 32 to cover the top of the fan housing wall 32.

The fan 7 is typically coupled to either the sloped body 31 or the raised center lip 25. When activated, the fan 7 draws air in through the air intake opening 2 formed by the first portion of the annular opening 23. Because the fan housing aperture 35, the outer opening 34, and the first portion of the annular opening are all in fluid communication with one another, activation of the fan 7 and the subsequent drawing of external air into the air intake 2 results in at least a portion of the external air being drawn into the fan housing 30 to the fan 7. The air is then dispersed by the fan 7 toward the platform 26. Because the second portion of the annular opening 23 is in fluid communication with the chamber of the enclosed convex portion 36, which is in fluid communication with the fan housing aperture 35, air within the sloped body 31 exhausts through the air exhaust opening 4 when the fan 7 is activate. By drawing external air into the sloped body 31 and blowing the air onto the platform 26 of the heat sink 20 before the air is ultimately exhausted, the overall temperature of the system 100, and particularly the heat sink 20 and the LED 5 is decreased.

A electrical junction box, or other in-wall mountable electrical housing box, (J-box) 50 may also be included in one or more embodiments of an LED cooling system 100, 200. J-Boxes, which are well known in the art and come in standard sizes with limited internal boundaries, is typically configured as a rectangular or cylindrical shape and is configured to house electrical components mounted in a wall or house wiring for electrical components. For particular embodiments of the present disclosure, portions of the heat sink 20, 70, the fan housing 30, 80, the cover 40, 90, and the adapter 60 are sized to fit within a standard J-Box. As used herein, a standard single-gang J-Box comprises a J-box having a volume of between approximately 14 cubic inches and approximately 21 cubic inches. According to various embodiments, the LED lighting systems contemplated in this disclosure are sized and configured for mounting within a single gang J-box having a volume of approximately 14 cubic inches. Other LED lighting systems may also be sized and configured to fit within other J-boxes of varying dimension and volumes. In one or more embodiments, the J-box 50 couples to the face plate 10. When coupled to the face plate 10, the J-box is positioned to abut the face plate 10 with a base of the J-box 50 or leave a gap or space between the base of the J-box 50 and the LED plate. Various embodiments of the LED cooling system 100, 200 are configured to fit within a standard electrical junction box typically offered in the housing industry. In some embodiments, the base of the J-box 50 abuts or is in direct contact with the plate 10, and air is drawn into and exhausted from the LED cooling system 100, 200 through an annular opening on the face plate 10. The J-box 50 may be utilized to hold the heat sink 20, 70, the fan housing 30, 80, and the cover 40, 90 together. Alternatively or additionally, various couplings known to a person having skill in the art may utilize to couple the heat sink 20, 70, the fan housing 30, 80, and the cover 40, 90 together, such as but not limit to screws, pins, adhesives, and the like.

Figure 6:
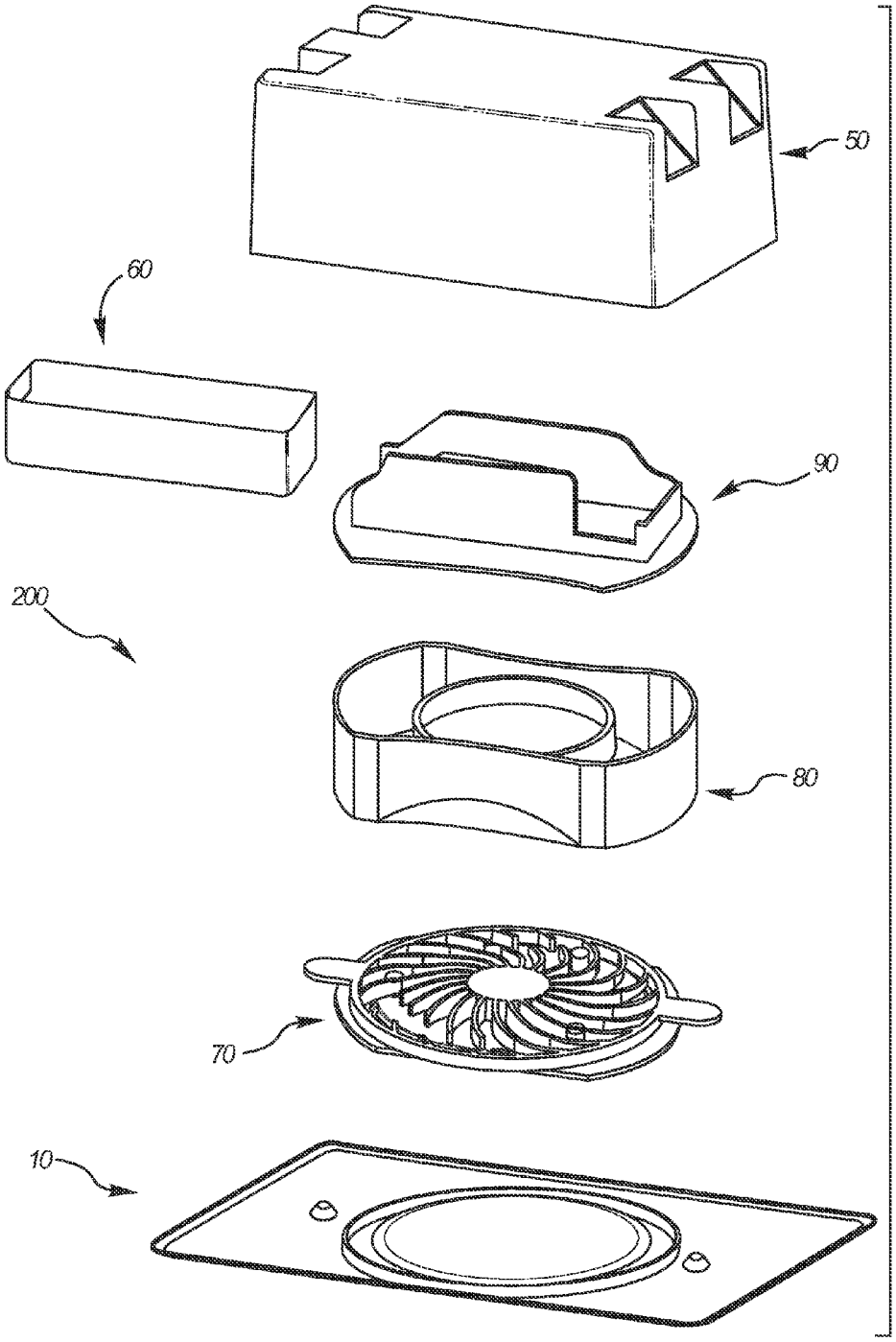
FIG. 6 is a break apart view of a second embodiment of a LED cooling system.

FIG. 6 illustrates another embodiment of an LED cooling system 200. Similar to LED cooling system 100, the LED cooling system 200 shown in an exploded view in FIG. 6 comprises an face plate 10, LED 5, and J-box 50 as previously described. The LED cooling system 200 also comprises a heat sink 70, a fan housing 80, and cover 90, although the configuration of these varies from the configuration of LED cooling system 100 as described below.

Figure 7:
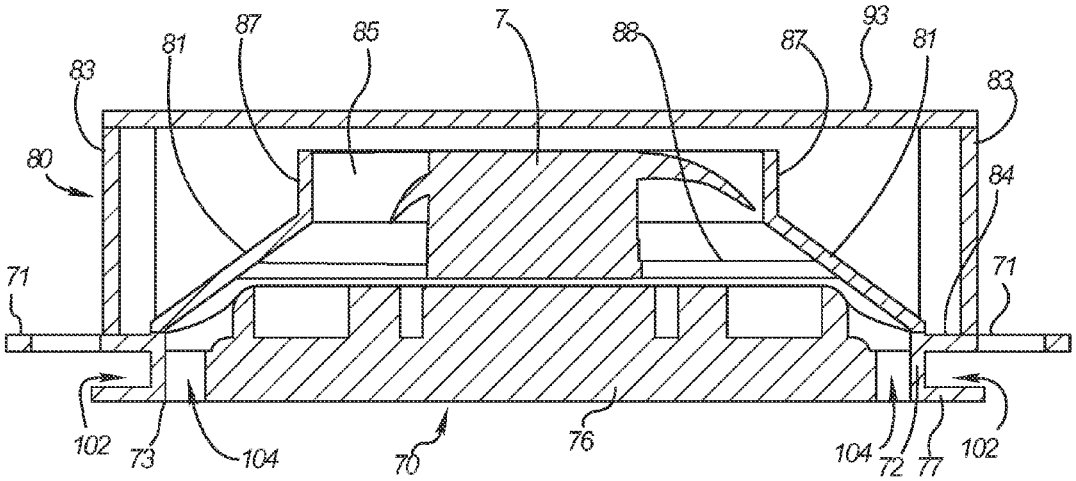
FIG. 7 is a cross sectional view of a second embodiment of a LED cooling system.
Figure 8:
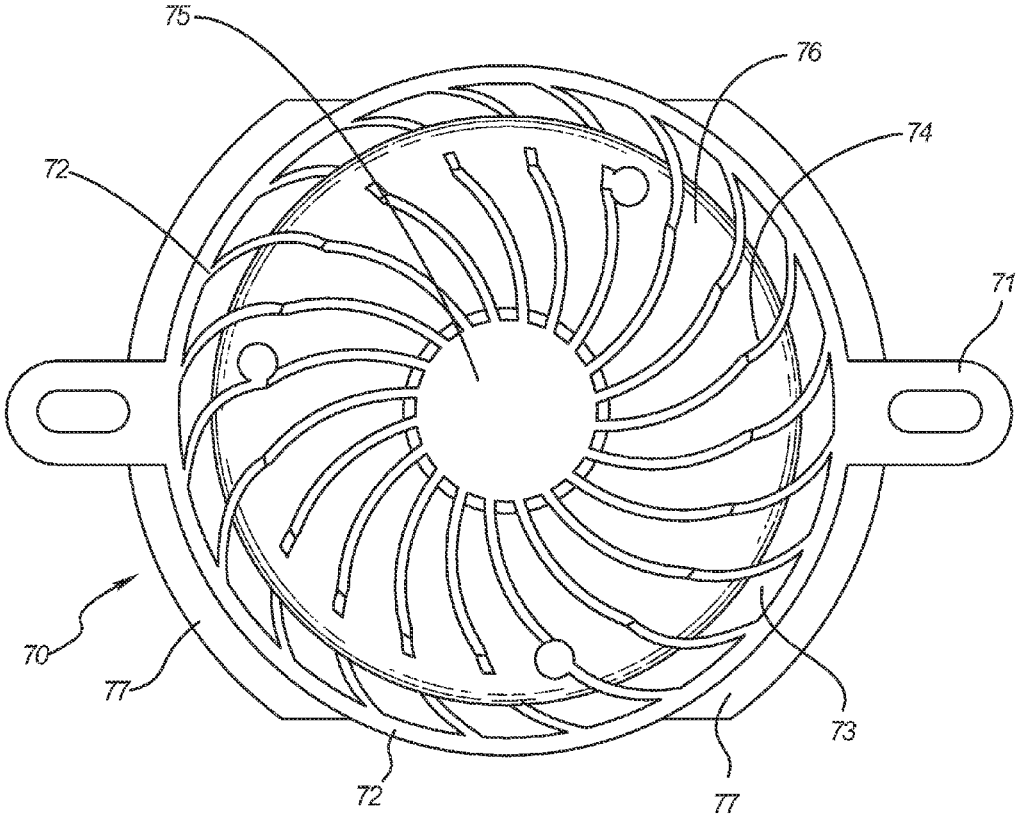
FIG. 8 is a top view of a second embodiment of a heat sink.

As shown in FIG. 6-8, the LED cooling system 200 comprises a heat sink 70. Although the heat sink 70 shown in FIGS. 6 and 8 is substantially circular in shape, embodiments of heat sinks comprises non-circular shapes (such as a rectangle, triangle, and the like) are also contemplated. One or more embodiments of the heat sink 70 comprise a circular platform 76 and a circular sink wall 72 separated by an annular opening 73. An array of ribs 74 may extend from a raised center member 75 on the platform 76 to the sink wall 72, thus bridge the annular opening 73 and coupling the platform 76 to the sink wall 72. In a particular embodiment, such as that shown in FIGS. 6 and 8, the ribs 74 comprise arced ribs 74. Ends of the ribs 74 opposite the raised center member 74 may be configured such that the ribs 74 do not contact the sloped body 81 when the fan housing 80 is coupled to the heat sink 70.

One or more embodiments of the heat sink 70 further comprise at least one sink lip 77 extending from the sink wall 72. In the embodiment shown in FIG. 8, the heat sink 70 comprises two opposing sink lips 77 each extending from the sink wall 72. The sink lips 77 typically extending from a base end of the sink wall 72. Embodiments of the heat sink 70 may further comprise at least one fastener mount 71 also extending from the sink wall 72. In the embodiment shown in FIGS. 6 and 8, the heat sink 70 comprises two opposing fastener mounts 71 positioned proximate the opposing sink lips 77. When positioned proximate one another, a sink lip 77 and a fastener mount 71 are at different heights on the sink wall 72 in some embodiments. For example, while the sink lip 77 may extend from a base end of the sink wall 72, the fastener mount 71 may extend from a top end of the sink wall 72 opposite the base end. In one or more embodiments, the fastener mounts 71 are positioned opposite one another and between the opposing sink lips 77 rather than proximate the opposing sink lips 77. In another embodiment, one or more fastener mounts 71 are positioned on or proximate the platform 76 such that the one or more fastener mounts 71 align with standard J-box housing 50. The heat sink 70 may further comprise one or more mounting holes for mounting the LED 5 to the heat sink 70, or, alternatively, coupling the heat sink 70 to the fan housing 80. The mounting holes are typically positioned on the platform 76.

Figure 9A:
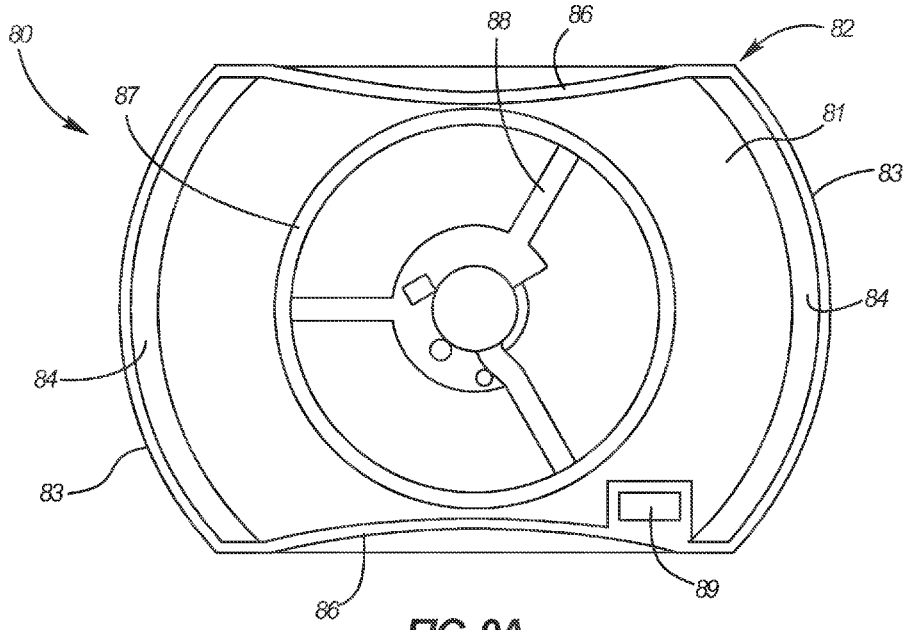
FIG. 9A is a top view of a second embodiment of a fan housing.
Figure 9B:
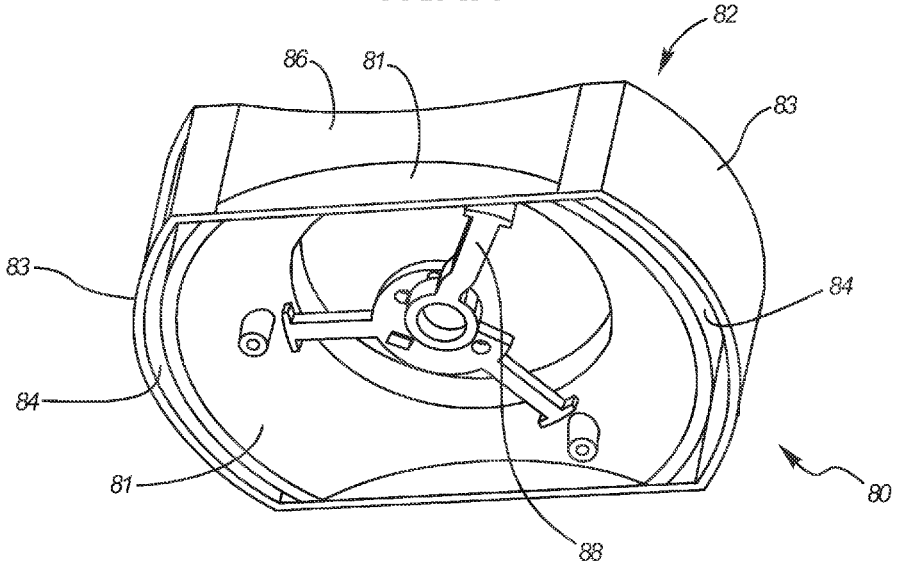
FIG. 9B is a bottom perspective view of a second embodiment of a fan housing.

FIGS. 9A and 9B illustrate top and perspective views, respectively, of an embodiment of a fan housing 80. The fan housing 80 typically comprises a dividing wall, such as a sloped body 81 partially within the fan housing walls 82. The fan housing walls 82, in one or more embodiments, comprises two opposing end walls and two opposing sidewalls. In the specific, non-limiting embodiment of FIGS. 9A and 9B, the two opposing end walls comprise two opposing convex portions 83 and the two opposing sidewalls comprise two opposing concave portions positioned between the two opposing convex portions 83. Various embodiments may also include a planar connector wall between each convex portion 83 and concave portion 86.

The sloped body 81 is typically shaped such that the base end of the sloped body 81 complements at least a portion of the sink wall 72. In FIG. 9B, the sloped body 81 comprises a substantially conical sloped body 81. Portions of the based end of the sloped body 81 may be planar, as shown in FIG. 9A. Extending from a top end of the sloped body 81 is a rim 87 in various embodiments. The rim 87 and the sloped body 81 together (or individually) form the boundary of a fan housing aperture extending through the sloped body 81. The fan housing wall 82 typically comprises a height dimension greater than a height dimension of the sloped body 81 (and the rim 87, if included). One or more embodiments of the fan housing 80 further comprise a fan mount 88 coupled to the sloped body 81 or the rim 87 within the fan housing aperture 85. As shown in FIG. 9B, wire slot 89 may also extend through the sloped body 81.

In one or more embodiments, at least one outer opening 84 is positioned between a convex portion 83 of the fan housing wall 82 and a portion of the sloped body 81. In the embodiment shown in FIGS. 9A and 9B, the fan housing 80 comprises two opposing outer openings 84, each outer opening 84 positioned between a different convex portion 83 of the fan housing wall 82 and a different portion of the sloped body 81. Because the height dimension of the sloped body 81 is less than the height dimension of the fan housing wall 82, each outer opening 84 is in fluid communication with the fan housing aperture 85.

Figure 16:
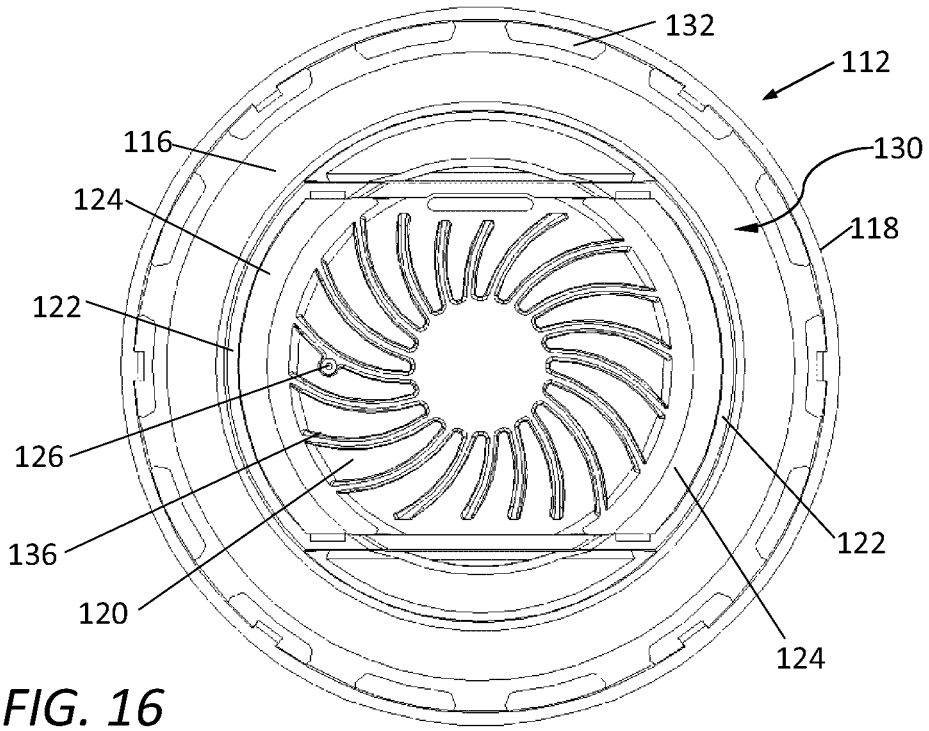
FIG. 16 is a rear view of a third embodiment of a head sink.
Figure 17:
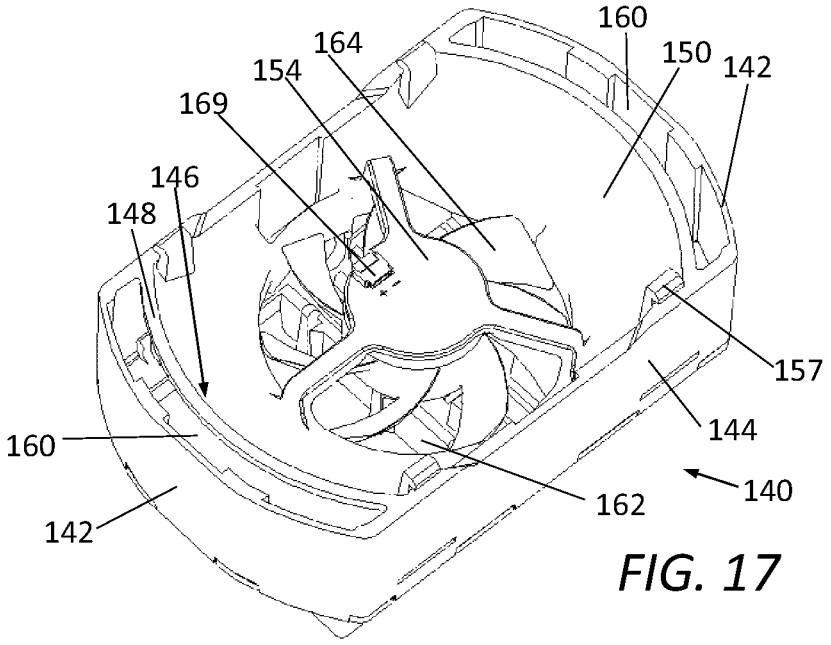
FIG. 17 is a front perspective view of a third embodiment of a fan housing.
Figure 18:
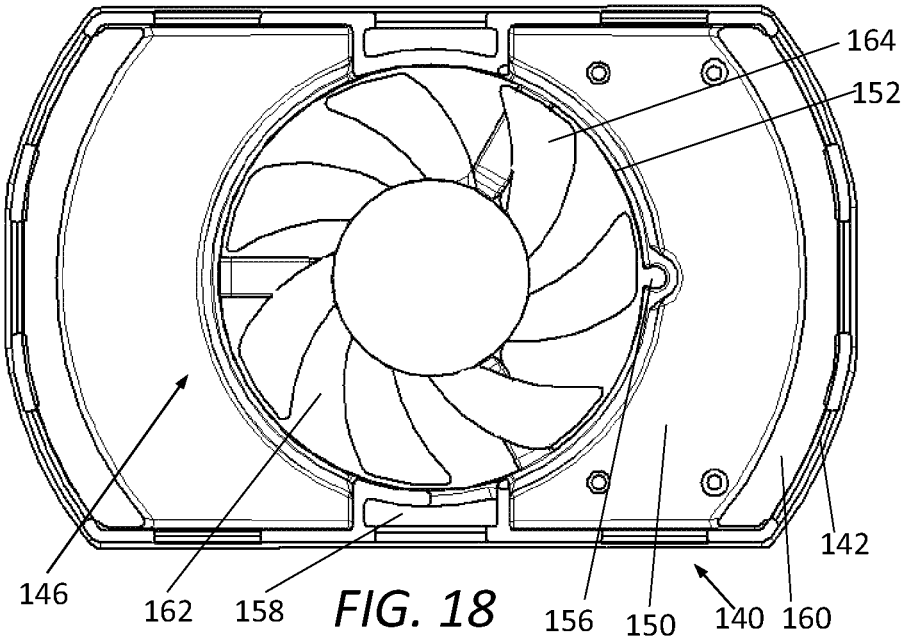
FIG. 18 is a rear view of a third embodiment of a fan housing.

FIGS. 17 and 18 depict various views of another non-limiting embodiment of a fan housing 140. The fan housing may be utilized with any of the LED lighting and cooling systems disclosed in this document. According to some aspects, a fan housing comprises one or more end walls 142. Dependent upon the configuration of the heat sink, in some embodiments the one or more end walls 142 comprise a circular wall. In other embodiments, such as the non-limiting embodiment depicted in FIGS. 14, 16, 18, 23, and 25 the fan housing 140 comprises two end walls 142 and two sidewalls 144. The two end walls 142 are typically opposite one another and separated by the two sidewalls 144, which sidewalls 144 are also opposite one another. In one or more embodiments, the sidewalls 144 of a fan housing 140 are substantially planar.

Figure 14:
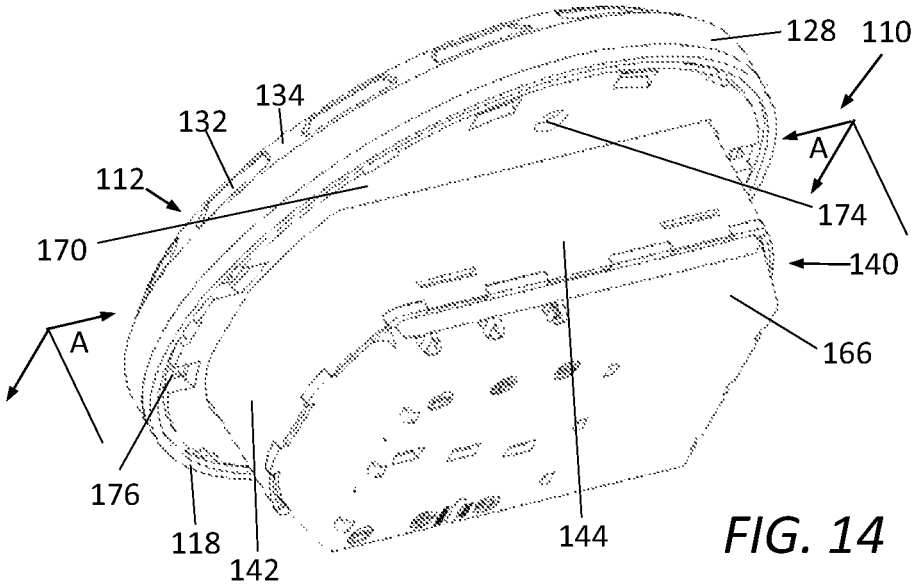
FIG. 14 is a rear perspective view of a third embodiment of an LED cooling system.
Figure 20:
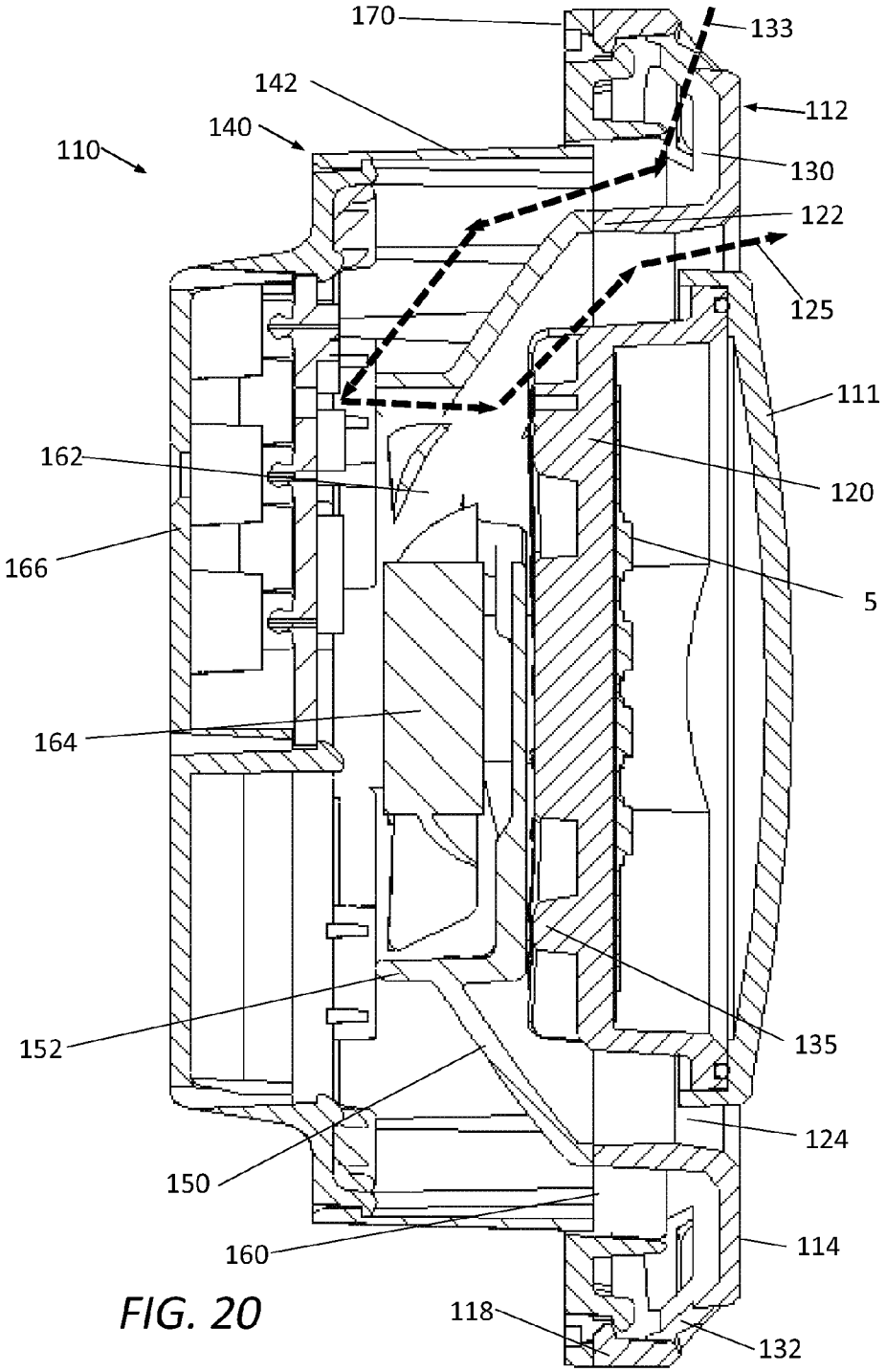
FIG. 20 is a cross-sectional view of a third embodiment of a LED cooling system taken along line A-A of FIG. 14.

Similar to some embodiments of the fan housing 80, some embodiments of the fan housing 140 comprise two opposing curved or convex end wall 142. In other embodiments, however, the outer wall may be substantially planar. As is shown in FIGS. 14 and 20, and described in greater detail below, in some embodiments of a fan housing 140, the end walls 142 are configured such that when the fan housing is coupled to a heat sink 112, 192, the end walls 142 are positioned between the sink wall 122, 202 and the outer periphery 118, 198 of the heat sink 112, 192. Similarly, when the fan housing 140 is coupled to a heat sink 70, the each end wall 142 is positioned between the sink wall 72 and the outer most edge of a different fastener mount 71.

In one or more embodiments, a fan housing 140 comprises one or more dividing walls 146 positioned within the chamber formed by the end walls 142 and the sidewalls 144. The one or more dividing walls 146 are configured to divide or otherwise separate air flowing into the fan housing 140 and air flowing out of the fan housing 140. According to some aspects, each dividing wall 146 comprises a sloped body 150 and a rim 152. In the non-limiting embodiment depicted in FIGS. 17, 18, and 20, the fan housing 140 comprises two dividing walls 146 each comprising a sloped body 150 and a rim 152. The sloped bodies 150 depicted in FIGS. 17 and 18 each intersect and are coupled to the two opposing sidewalls 144. The sloped bodies 150 are configured such that if they continued through the sidewalls 144, the two sloped bodies 150 would form a cone.

Each dividing wall 146 further comprises a terminating end 148. The terminating end 148 is typically on an end of the sloped body 150 distal the rim 152. The terminating end 148 is configured to align with and be adjacent to a sink wall 72, 122, 202 of a heat sink 70, 112, 192 when the fan housing is coupled thereto. Accordingly, the terminating end 148 of the dividing wall 146 is typically arced substantially equal to the arc of the respective sink wall 72, 122, 202.

A rim 152 of a dividing wall 146 is typically positioned opposite a terminating end 148 of the dividing wall 146. In particular embodiments, the rims 152 of the two opposing dividing walls 146 are positioned to form a singular and continuously circular rim. The rims 152 are sized and positioned such that a fan 164 may be positioned therein. A fan housing aperture 162 is formed at the rims 152, the fan housing aperture 162 allowing fluid communication between the outer opening 160 and the fan 164 (when mounted therein), and between the fan 164 and the platform 76, 120, 200 and openings 73, 124, 204 of the heat sink 70, 112, 192. In one or more embodiments, the fan housing 140 comprises a fan mount 154 configured to mount or couple a fan 164 within the fan housing 140. In particular embodiments, the fan mount 154 is positioned within the fan housing aperture 162 and extends from one or more sloped bodies 150 of the dividing walls 146.

As noted above, each fan housing 140 typically further comprises an outer opening 160. The outer opening 160 is configured to allow air to flow into or out of the fan housing 140 upon activation of the fan 162. In one or more embodiments, each outer opening 160 is positioned between a dividing wall 146 and an end wall 142. More particularly, an outer opening may be positioned between a terminating end 148 of the sloped body 150 and the nearest end wall 142.

One or more embodiments of a fan housing 140 further comprise at least one coupling 158 configured to removably couple a cover 166 to the end wall 142 and or sidewalls 144 of the fan housing 140. According to some aspects, the couplings 158 are positioned proximate the rim 152 and/or the sidewall 144. In other embodiments, the couplings may be positioned on or near the end walls 142. The couplings may comprise any coupling that allows for removable for fixable coupling of a cover 166 to the sidewalls 144 and/or the end wall 142, such as but not limited to snap couplings, biased couplings, pins, screws, and the like.

According to some aspects, the fan housing may be integrally formed. More particularly, in one or more embodiments, the end walls 142, the sidewalls 144, the dividing walls 146, and the fan mount 154 are integrally formed. In some embodiments, the cover 166 may also be integrally formed, while in other embodiments, the cover 166 is not integrally formed with other aspects of the fan housing 140.

Various embodiments further comprise a cover 166. As previously noted, the cover 166 is typically configured to removably of fixedly couple to couplings 158 positioned elsewhere on the fan housing 140 such that the cover 166 is distal the heat sink 70, 112, 192. The cover 166 is configured to substantially prevent or otherwise inhibit air from escaping from a top end of the fan housing 140. Instead, the cover 166 is configured to allow air to enter the fan housing 140 through the outer opening 160 and exit the fan housing 140 through the fan housing aperture 160. The cover 166 may further comprise an adapter board and/or a circuit board 168 configured for operation of the lighting device as described herein and as understood by those of ordinary skill in the art of LED lighting from this disclosure.

Figure 12:
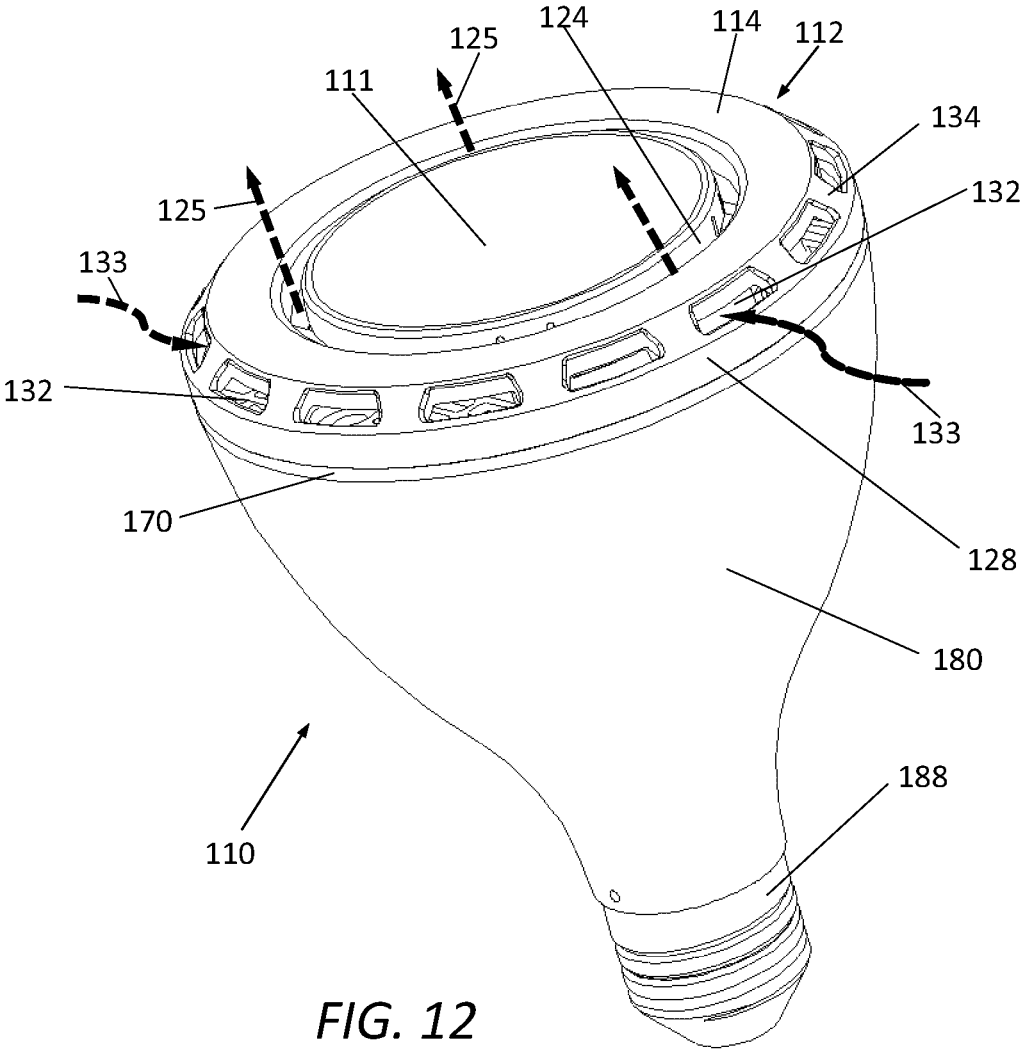
FIG. 12 is a perspective view of a third embodiment of an LED cooling system coupled to a bulb-like housing.

One or more embodiments of a fan housing 140 are configured to fit within a J-Box 50. The same or other embodiments are of a fan housing 140 are also configured to fit within a bulb-like housing 180, as depicted in FIG. 12. Thus, configuration of a fan housing 140 is advantageous to conventional fan housings, which typically cannot be mounted within a J-Box 50 or interchangeable between mounting within a bulb-like housing 180 and a J-Box 50.

One or more embodiments of a fan housing 140 further comprising a plurality of a coupling tabs 157 extending from the side of the housing adjacent or abutting a heat sink. The coupling tabs 157 are configured to extend into receivers on the heat sink to couple the fan housing 140 to the heat sink. In some embodiments, the coupling tabs 157 comprise biased coupling tabs. In these or alternative embodiments, the coupling tabs comprise a head that allows the coupling tab 157 to clip or snap fit the fan housing 140 to the heat sink.

FIG. 7 illustrates a partial cross-sectioned view of a LED cooling system 200. Although not shown in FIG. 7, a LED 5 and/or face plate 10 are sometimes coupled to the heat sink 70 below the heat sink 70. As shown in FIG. 7, each opposing concave portion 83 of the fan housing wall 82 abuts or contacts a fastener mount 71. Because the fastener mount 71 and the sink lip 77 extend from the sink wall 72 at different heights, an air intake opening 102 is formed between the sink lip 72 and the fan housing walls 82. The air intake opening 102 is in fluid communication with the outer opening 84 of the fan housing 80, which outer opening is in fluid communication with the fan housing aperture 85.

FIG. 7 further illustrates an air exhaust opening 104 formed by the annular opening 73 of the heat sink 70. The base end of the sloped body 81 abuts the sink wall 72 in one or more embodiments. Thus the air exhaust opening 104 is in fluid communication with the annular opening 73 and the fan housing aperture 85.

Upon activation of the fan 7 within the rim 87 and sloped body 81, external air is drawn from outside the system through the two opposing air intake openings 102, through the outer openings 84 of the fan housing 80 to the fan 7 within the sloped body 81. Rotation of the fan 7 subsequently directs the air towards the platform 76 of the heat sink 70 and ultimately through the two opposing air exhaust openings 104. Inclusion of the two air intake openings 102 and the two air exhaust openings 104 allows for introduction of more external air through the air intake openings 102 followed by exhaustion of hot air from the system through the two air exhaust openings 104 when the fan is activated. Transfer of the external air through the system and blowing of the fan 7 on the platform 76 results in cooling of the system 200 generally and the platform 76 specifically.

Figure 11:
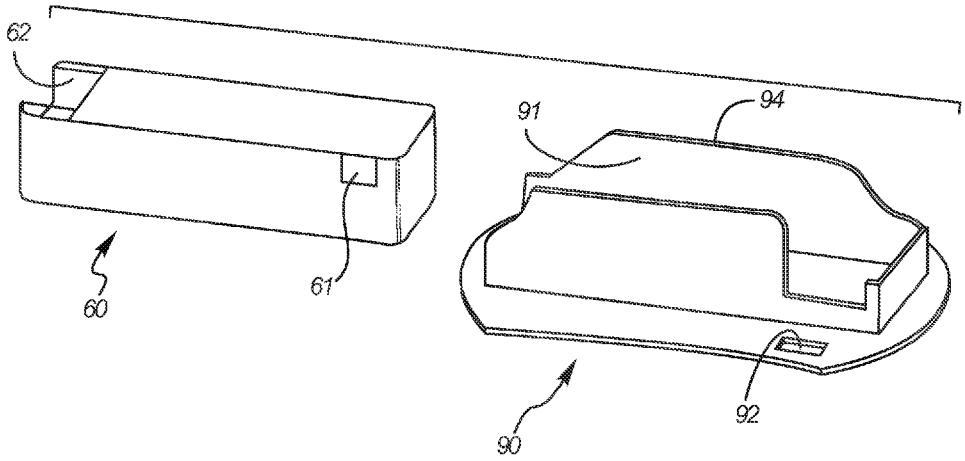
FIG. 11 is a break apart view of a power adapter and Wi-Fi module and a cover

FIG. 11 illustrates an embodiment of a power adapter 60 and a cover 90. Although not shown with the figures associated with LED cooling system 100, the power adapter 60 shown in FIG. 11 may be utilized in the either LED cooling system 100 or 200. The power adapter typically comprises an AC input 62 and a DC output 61. According to various aspects, the power adapter 60 further comprises a removable wi-fi module 63. The wi-fi module may comprise any wi-fi module known in the art configured for use in the LED cooling system. The wi-fi module 63 is configured to allow a user to control the light functions through a communication network. As shown in FIG. 11, one or more embodiments of a cover 90 comprise an adapter channel positioned between two channel walls 94. The channel walls 94 typically extend from a cover base 93 shaped to align with the fan housing walls 82. Some embodiments of the channel walls 94 comprise arced interior portions that allow for removable coupling of the adapter 60 within the adapter channel 91. A fan wire slot 92 may also extend through the cover base 93 and align with the wire slot 89 of the fan housing 80.

Figure 10:
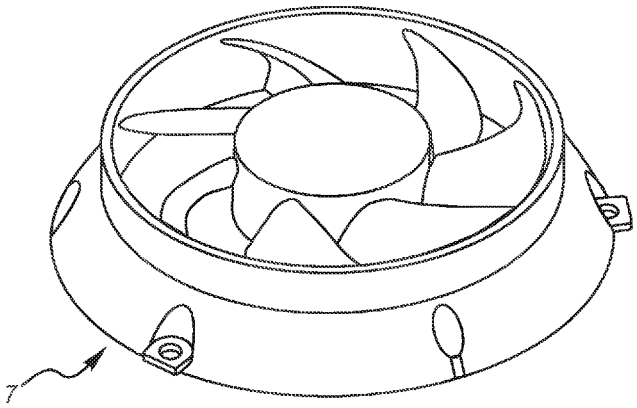
FIG. 10 is a perspective view of a fan.

FIG. 10 illustrates an embodiment of a fan 7 used in various embodiments of LED cooling systems disclosed herein. Any fan sized to fit within the fan housing apertures 35, 85 may be utilized in various embodiments. In particular embodiments, the fan 7 comprises a fan housing shaped to complement the sloped body 31, 81 and the rim 87 of the fan housing 30, 80. One or more embodiments of the fan 7 comprise three blades and four struts. The adapter 60 and/or batteries may provide power to activate the fan 7. In one or more embodiments, the fan 7 is included within the fan housing 30, 80 during assembly, while in other embodiments, the fan 7 may be removably coupled within the fan housing 30, 80 after assembly. The fan 7 may be coupled to the fan housing 30, 80 with any couplings known in the art, such as but not limited to screws, pins, adhesives, magnets, and the like.

FIG. 18 depicts another embodiment of a fan 164 contemplated for use with various embodiments of this disclosure. The fan 164 is typically sized to fit within the fan housing aperture 162 and, more particularly, within the circular rim 152 formed between the dividing walls 146. In particular embodiments, the fan 164 does not require or include the fan housing shown in accordance with the fan 7 of FIG. 10.

Figure 13:
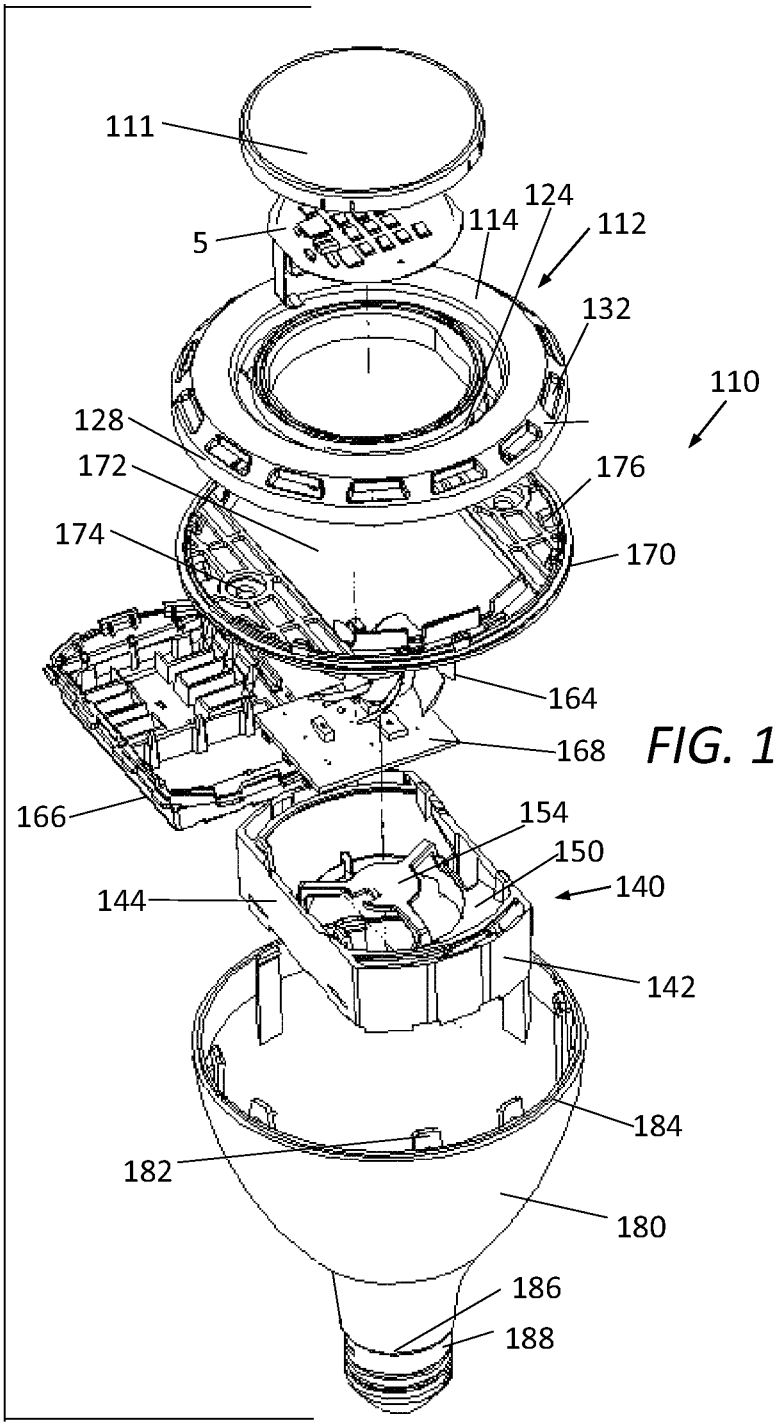
FIG. 13 is an exploded perspective view of a third embodiment of an LED cooling system.

FIGS. 12-20 depict another non-limiting embodiment of a LED lighting and cooling system 110. FIG. 14 depicts a rear perspective view of a LED lighting and cooling system 110 having a housing 140 coupled to a heat sink 112. Although the fan housing 140 is depicted in these figures, it is contemplated that the fan housing 80 or other fan housing embodiments described herein may be substituted without departing from the scope of this disclosure. FIG. 13 depicts an exploded view of a non-limiting embodiment of a LED lighting system 110. According to some aspects, a LED lighting system 11 comprises a LED 5, an LED cover 111, a heat sink 112, and a fan housing 140. More particular embodiments may further comprise a bulb-like housing 180 (shown in FIGS. 12 and 13), although this bulb-like housing 180 is not required in all LED lighting systems 110.

Figure 15:
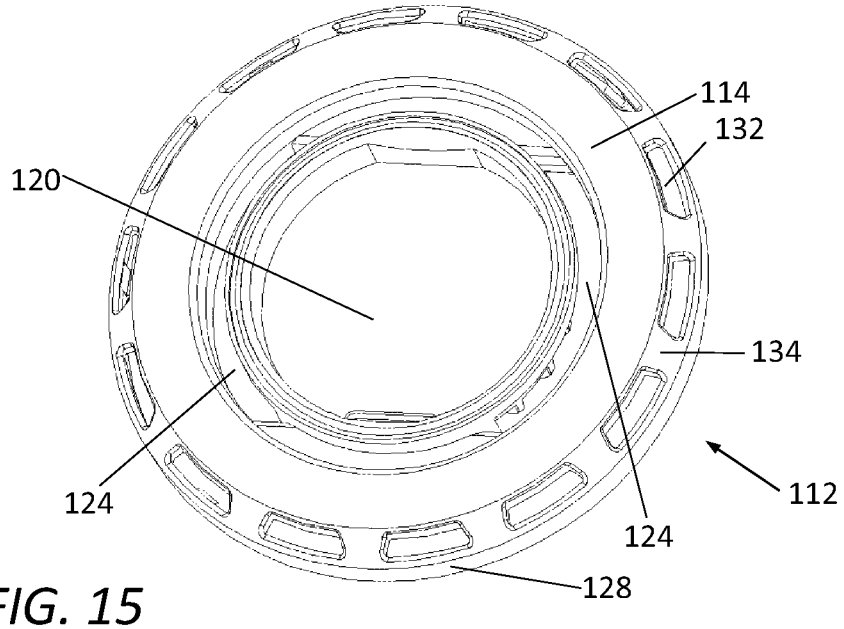
FIG. 15 is a front perspective view of a third embodiment of a heat sink.

LED lighting system 110 typically comprises a heat sink 112. FIG. 15 depicts a front view and FIG. 16 depicts a rear view of a non-limiting embodiment of a heat sink 112. The heat sink 112 may comprise any metal known in the art. In one or more embodiments, the entire heat sink 112 is metal. In other embodiments, portions of the heat sink may not be metal, as shall be described in greater detail below. According to some aspects, a heat sink 112 comprises an outer surface 114, to which the LED 5 and LED cover 111 are coupled, and an inner surface 116, to which the fan housing 140 is coupled.

Embodiments of a heat sink 112 further comprise an outer periphery 118. Although the outer periphery 118 shown in FIGS. 15 and 16 is substantially circular, it is contemplated that the outer periphery may comprise any other shape. According to some aspects, a heat sink 112 further comprises an outer wall 128 positioned on the outer periphery 118 of the heat sink 112. The outer wall 128 may extend out from the surface 116, out from the outer surface 114, or both. In one or more embodiments, the outer wall 128 comprises an angled portion 134.

In one or more embodiments, a heat sink 112 further comprises one or more air intake openings 132. Typically, a plurality of air intake openings 132 extend through the heat sink 112. According to some aspects, the air intake openings 132 extend through the outer wall 128 of a heat sink 112. More particularly, the air intake openings 132 may extend through the angled portion 134 of the outer wall 128 of the heat sink 112. Positioning of the air intake openings 132 on the angle portion 134 of the outer wall 128 creates a larger surface area of each air intake opening 132 due to the angle configuration of the angled portion 134. This greater surface area allows for a greater volume of air to flow into the LED lighting system 110, which in turn creates a more efficient cooling system in the LED lighting system 110.

One or more embodiments of a heat sink 112 further comprise a platform 120 extending from the inner surface 116 of the heat sink 112. The platform 120 may be shaped substantially similar to the shape of the heat sink 112, such as but not limited to a circular shape. According to some aspects, the platform 120 is substantially and continuously solid. In other embodiments, the platform may comprise various openings extending therethrough or chambers positioned therein. In the particular non-limiting embodiment depicted in FIG. 16, the heat sink 112 comprises two air exhaust openings 124 extending through the platform 120 or otherwise adjacent to the platform 120. The heat sink 112 typically further comprises a sink wall 122 bordering each air exhaust opening 124 such that the air exhaust opening 124 is positioned between a sink wall 122 and a portion of the platform 120. The sink wall 122 may be connected to or continuous with the platform 120 or, alternatively a separate protrusion from the platform 120.

In one or more embodiments of a heat sink 112, each sink wall 122 is adjacent to or abutting with a different one of the terminating ends 148 of the dividing wall 146 of the fan housing 140 when the heat sink 112 is coupled to the fan housing 140. In such a configuration, air exhausts from the fan housing 140 and the LED lighting system 110 through the air exhaust openings 124 upon activation of the fan 164. Positioning of the sink wall 122 of this non-limiting embodiment is also advantageous over conventional LED lighting systems because the metal sink wall 122 separates air being exhausted from the system from air being brought into the system. Because the sink wall 122 is metal, the sink wall will absorb some of the heat of the air being exhausted from the system, meaning that it is less likely that the sink wall 122 itself will heat air entering the system.

Formed between the outer wall 128 and the platform 120 and/or the sink wall 122 is typically a heat sink channel 130. According to some aspects, when a fan housing 140 is coupled to a heat sink 112, each end wall 142 of the fan housing is positioned over the heat sink channel 130 and thus between a sink wall 122 and a portion of the outer periphery 118 of the heat sink 112. In such embodiments, an outer opening 160 of the fan housing 140 is also positioned over a portion of the heat sink channel 130.

One or more embodiments of a heat sink 112 further comprise a plurality of arced ribs 136 protruding from the platform 120. The arced ribs 136 are positioned to enhance air flow as the fan 164 directs air onto the platform 120, thus improving the efficiency of cooling of the heat sink. The heat sink 112 may further comprise one or more screw holes 126 positioned on the heat sink 112 to allow coupling of the heat sink 112 to a J-Box 50. In particular embodiments, the heat sink 112 comprises two screw holes 126 spaced at distance from one another to allow a single gang or a double gang J-Box 50 to fit between the two screw holes 126. Embodiments of a heat sink 112 may further comprise one or more receivers that are configured to couple the fan housing 140 to the heat sink 112.

FIG. 20 depicts a cross-sectional view of an LED lighting system 110. In operation, the LED lighting system 110 improves the cooling efficiency of the system in comparison to conventional LED lighting systems. When a fan 164 in the LED lighting system 110 is activated, airflow 133 typically enters the system through the plurality of air exhaust openings 132 on the heat sink 112, passes through the heat sink channel 130 and into the outer openings 160 of the fan housing 140. Once within the fan housing 140, air passes through the fan housing apertures 162 and the airflow 125 is exhausted from the system through the air exhaust openings 124 on the heat sink 112.

Figure 19:
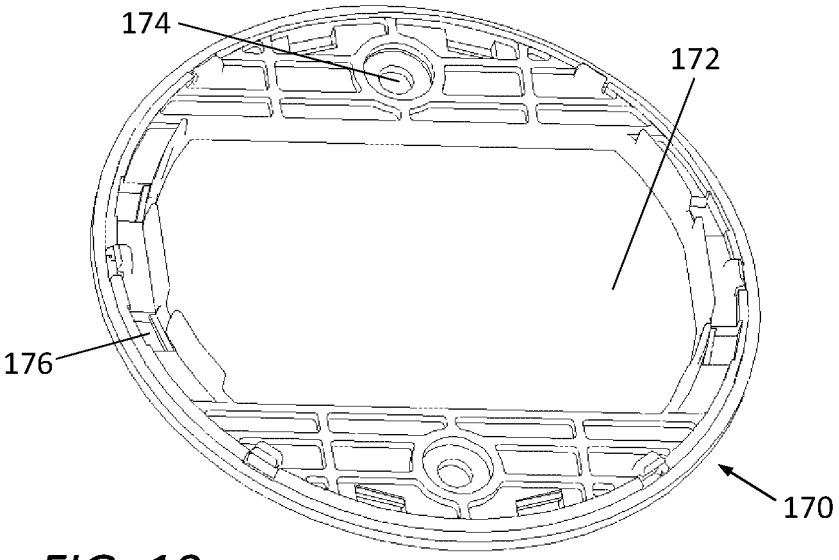
FIG. 19 is a front perspective view of a first embodiment of a mounting ring.

Various embodiments of an LED lighting system 110 further comprise a mounting ring 170 configured to allow the heat sink 112 and housing 140 to couple to a bulb-like housing 180 (shown in FIG. 12) or a flat surface such as a wall having a J-Box 50 mounted therein. FIG. 19 depicts a non-limiting embodiment of a mounting ring 170. According to one aspect, the mounting ring 170 comprises a fan housing opening 172 extending through the mounting ring 170 and sized to allow the fan housing 140 to at least partially pass therethrough. The mounting ring 170 typically further comprises a plurality of screw holes 174. In some embodiments, the mounting ring 170 comprises two screw holes 174 positioned to align with the screw holes on a J-Box 50. For example, in a non-limiting embodiment, the screw holes 174 are positioned at an approximate distance of between approximately 3.25 inches and approximately 3.5 inches from one another. The mounting ring 170 may further comprise additional screw holes positioned such that either a single gang or double gang J-Box 50 may fit between the additional screw holes. One or more embodiments of a mounting ring 170 further comprise one or more tab openings 176. The tab openings 176 are positioned to receive the coupling tabs of a bulb-like housing 180 to removably couple the mounting ring 170 to the bulb-like housing 180.

FIG. 12 depicts a non-limiting embodiment of an LED lighting system 110 coupled to a bulb-like housing 180, while FIG. 13 depicts an exploded view of an LED lighting system adapted to couple to a bulb-like housing. According to some aspects, the bulb-like housing 180 comprises an open first end 184, a second end 186 distal the open first end 184, and a socket fitting 188 coupled to the second end 186. The socket fitting 188 is typically configured to removably couple to a light socket previously known in the art. The LED lighting system 110 may further comprise one or more electrical wires that operably couple the socket fitting 188 to the circuit board 168 and the fan 164.

One or more embodiments of a bulb-like housing 180 further comprise at least one coupling tab 182. The at least one coupling tab 182 is positioned and configured to partially pass through a tab opening 176 on the mounting ring 170. The coupling tab 182 may comprise a lip that removably couples the mounting ring 170 proximate the bulb-like housing 180. Before or after the mounting ring 170 is coupled to the bulb-like housing 180, the heat sink 112 may be coupled to the mounting ring 170 by aligning the screw holes 126 with the additional screw holes on the mounting ring and inserting a screw, rod, or other coupling device. When the mounting ring 170, the heat sink 112, and the fan housing 140 are coupled to the bulb-like housing 180, the fan housing 140 is positioned at least partially within the bulb-like housing 180. However, the LED lighting system 110 typically does not pass air through the bulb-like housing 180. Instead, airflow generating by the fan 164 is typically contained within the fan housing 140 and heat sink 112 without a significant or appreciable amount flowing into the bulb-like housing 180.

Figure 21:
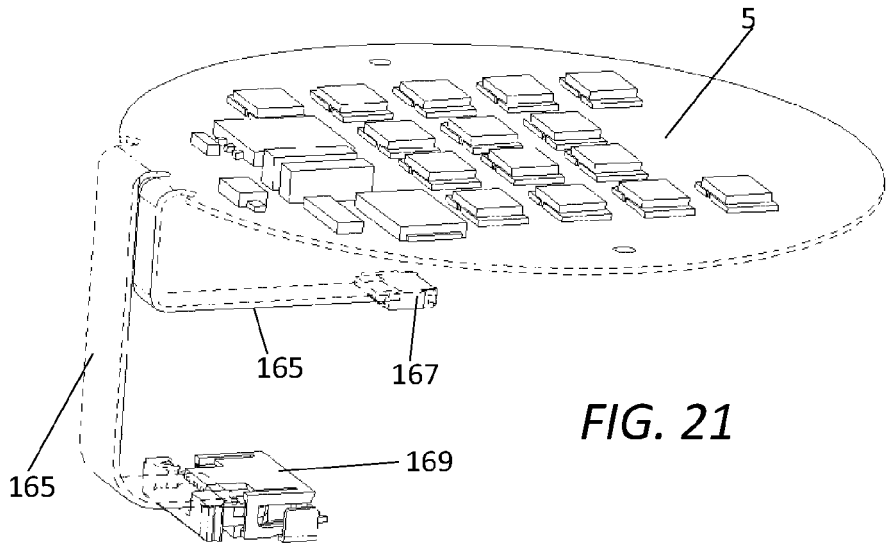
FIG. 21 is a perspective view of a LED and electrical couplings.

FIG. 21 depicts a non-limiting embodiment of a LED 5 and associated power couplings. Whereas conventional LED lighting system requires electrical connections be made by wire, contemplated herein is electrical connections or couplings made with a thin printed circuit board (PCB) 165, sometimes referred to as flex boards. Thus, in contrast to conventional LED lighting systems, no wire connections or connectors of some disclosed embodiments are located on the LED emitter board. Because wire connection and/or connectors on conventional LED emitter boards require sufficient spacing to meet UL and certification requirements, the LED 5 and the LED lighting system 110 may be significantly smaller than those previously known in the art.

Another advantage of utilizing PCB flex boards 165 is the ease in which the system may be assembled. Conventional systems require time and labor intensive soldering of wire or special terminations. These time and labor intensive aspects are not require according some aspects of this disclosure.

In one or more embodiments, two PCB flex boards 165 are operably coupled to the LED 5 emitter board. According to one aspect, a first PCP flex board 165 is operably coupled to a power source with a first coupling 169. A second PCP flex board 165 is operably coupled to the fan 164 with a second coupling 167. The first coupling 169 and second coupling 167 may comprise any type of coupling, such as but not limited to clips for removable couplings.

Figure 22:
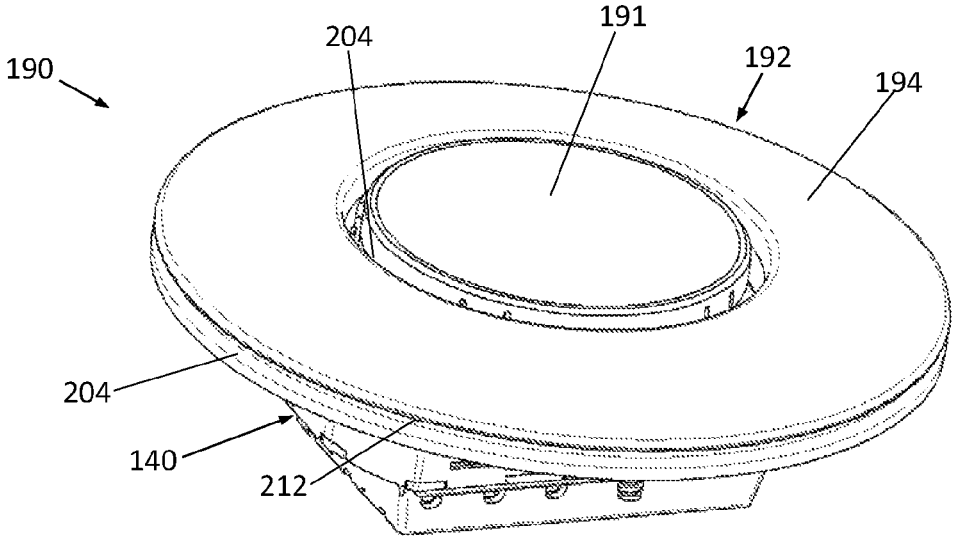
FIG. 22 is a front perspective view of a fourth embodiment of an LED cooling system.
Figure 23:
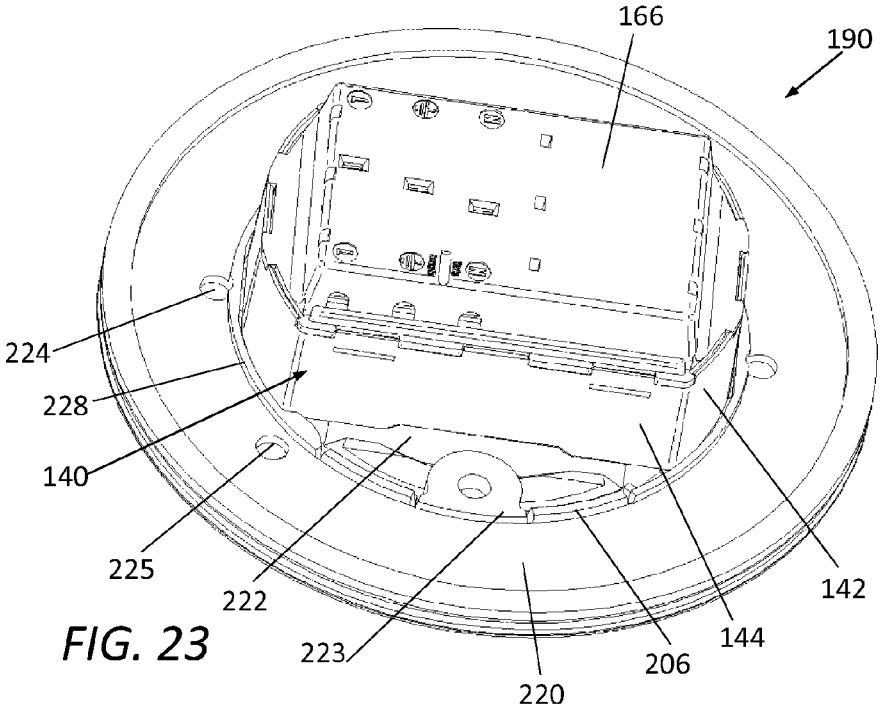
FIG. 23 is a rear perspective view of a fourth embodiment of an LED cooling system.
Figure 24:
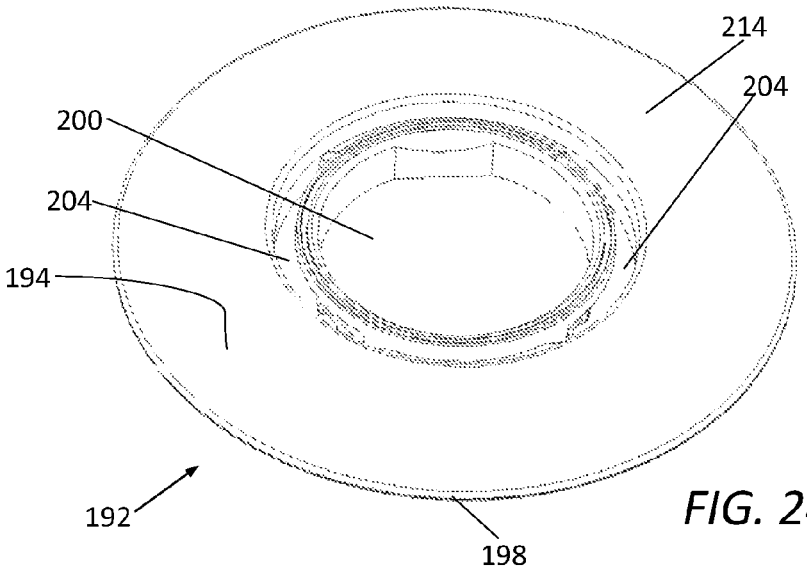
FIG. 24 is a front perspective view of a fourth embodiment of a heat sink.
Figure 25:
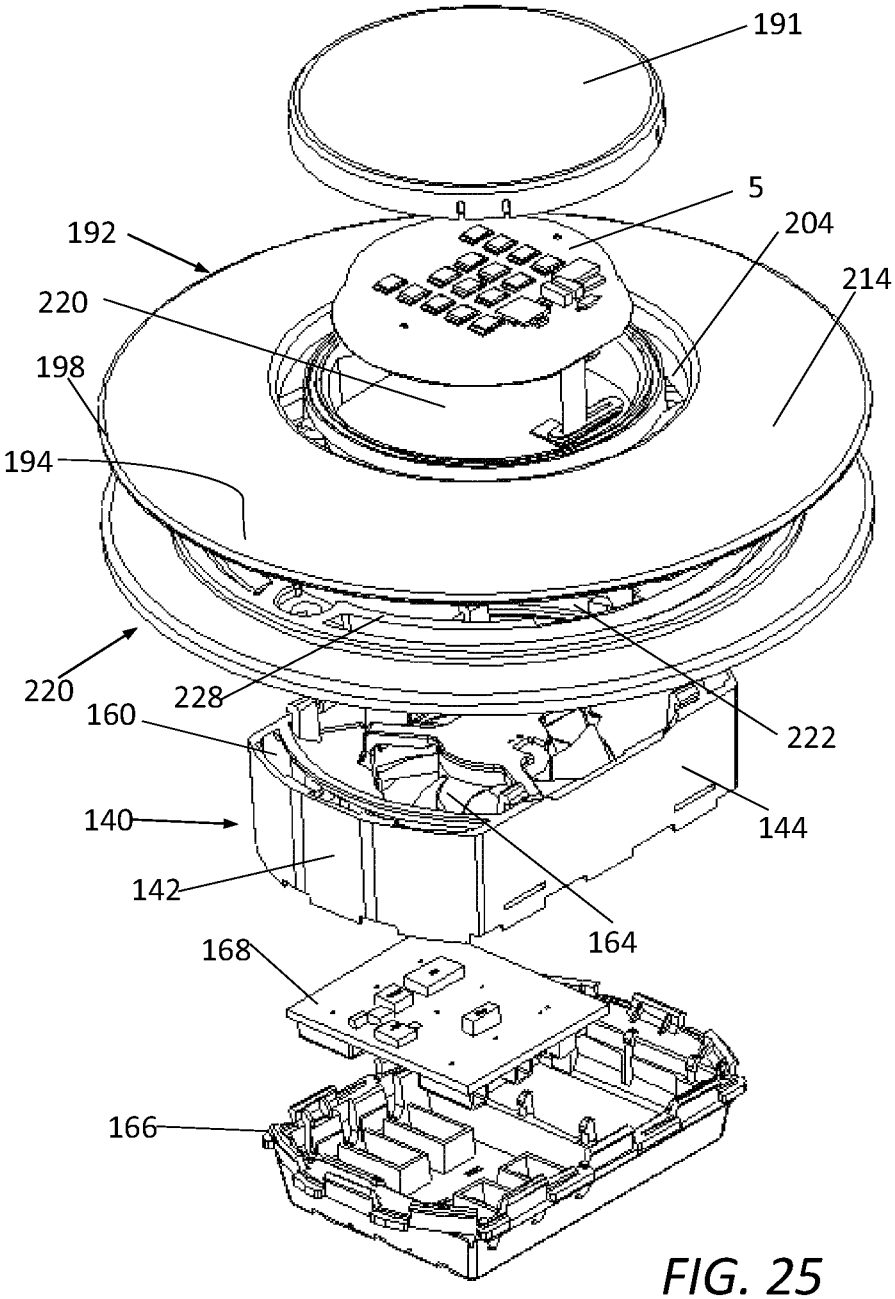
FIG. 25 is an exploded perspective view of a fourth embodiment of an LED cooling system.
Figure 26:
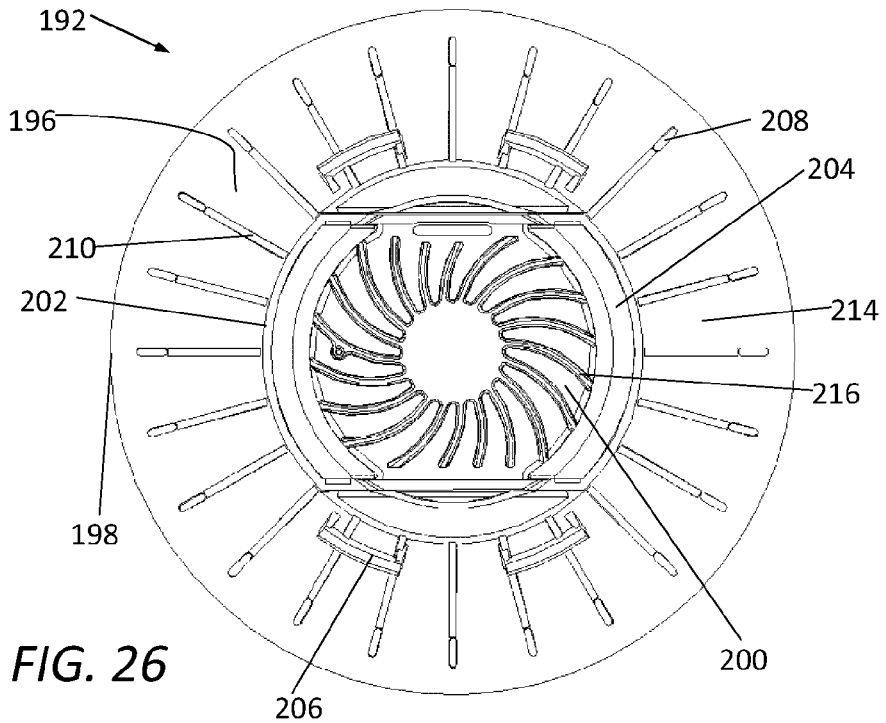
FIG. 26 is a rear view of a fourth embodiment of a heat sink.
Figure 27:
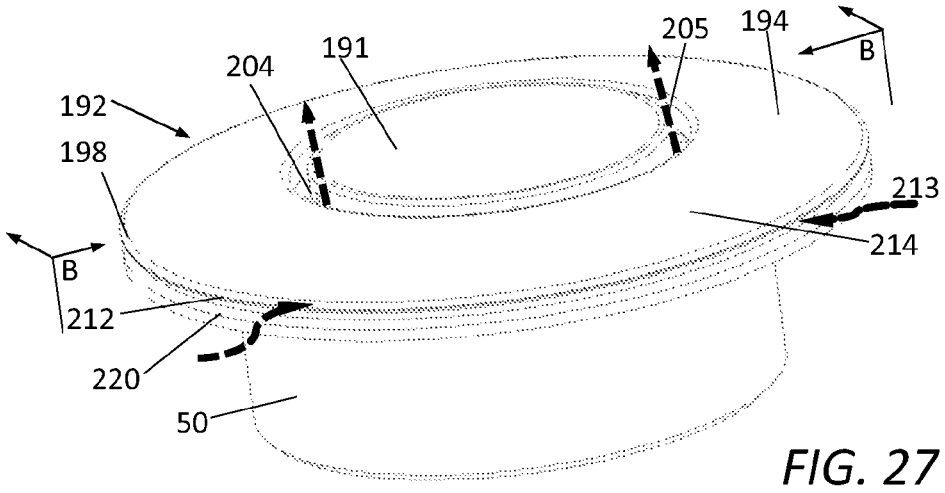
FIG. 27 is a perspective view of a fourth embodiment of an LED cooling system within a housing.

FIGS. 22-29 depict various views of another non-limiting embodiment of a LED lighting system 190. Various embodiments of a LED lighting system 190 comprise any of the fan housings described herein, including but not limited to a fan housing 140. FIGS. 22 and 23 depict front and rear perspective views, respectively, of a LED lighting system 190. As depicted in the exploded view of FIG. 25, one or more embodiments of a LED lighting system 190 further comprise a heat sink 192, one or more LEDs 5 coupled to an outer surface of the heat sink 192, a mounting ring 220 coupled to an inner surface 196 of the heat sink 192, and an LED cover 191 coupled to the outer surface 194 of the heat sink 192 and positioned to cover the LED 5. According to some aspects, the heat sink 192 comprises an outer periphery 198. The outer periphery 192 may comprise any suitable shape, include but not limited to a circular outer periphery 198.

One or more embodiments of a heat sink 192 further comprise a platform 200 extending from the inner surface 196 of the heat sink 192. The platform 200 may be shaped substantially similar to the shape of the heat sink 192, such as but not limited to a circular shape. According to some aspects, the platform 200 is substantially and continuously solid. In other embodiments, the platform may comprise various openings extending therethrough, chambers positioned therein, or lips protruding therefrom. In the particular non-limiting embodiment depicted in FIG. 26, the heat sink 192 comprises two air exhaust openings 204 extending through the platform 200 or otherwise adjacent to the platform 200. The heat sink 192 typically further comprises a sink wall 202 bordering each air exhaust opening 204 such that the air exhaust opening 204 is positioned between a sink wall 202 and a portion of the platform 200. The sink wall 202 may be connected to or continuous with the platform 200 or, alternatively a separate protrusion from the platform 200.

Figure 28:
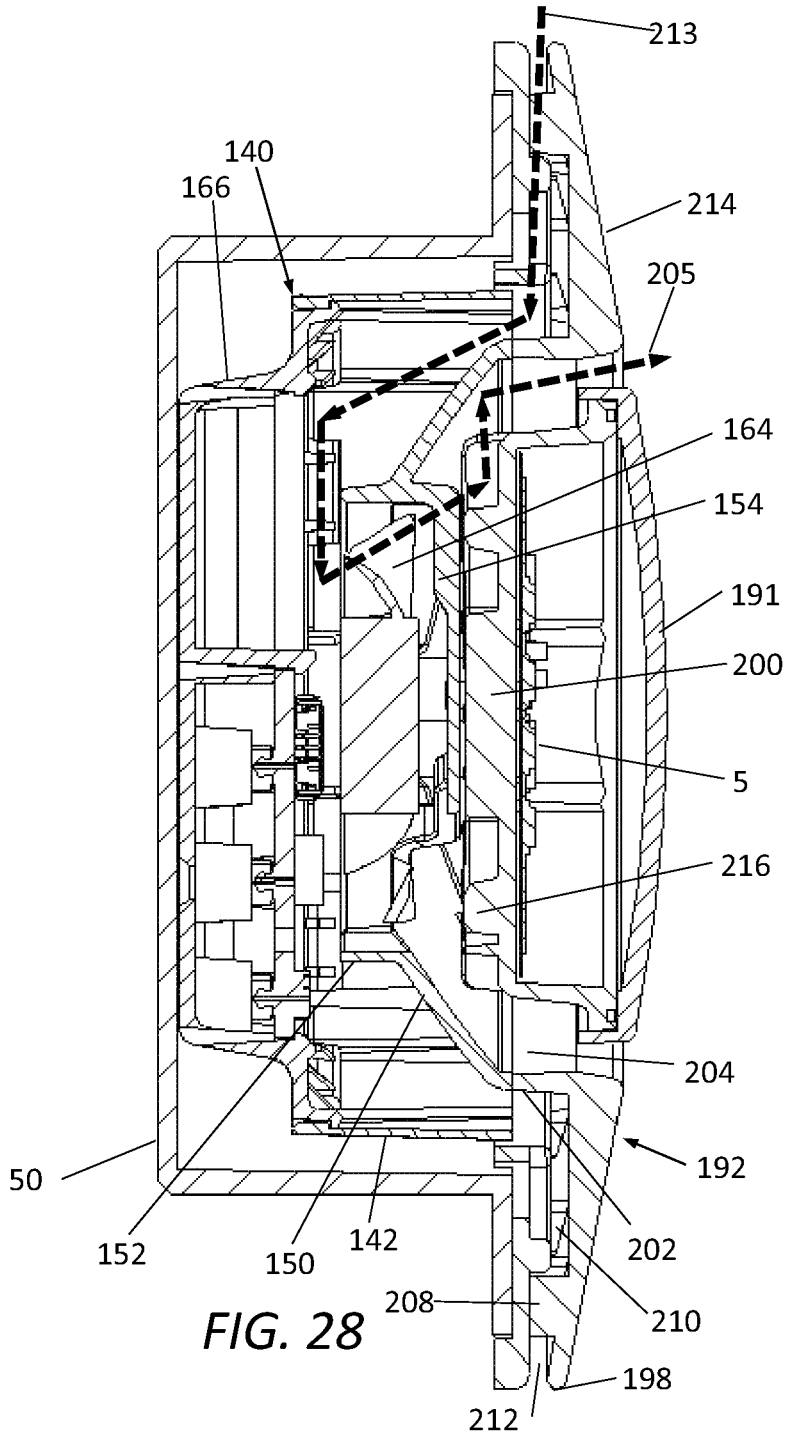
FIG. 28 is a cross-sectional view of a fourth embodiment of an LED cooling system taken along line B-B of FIG. 27.
Figure 29:
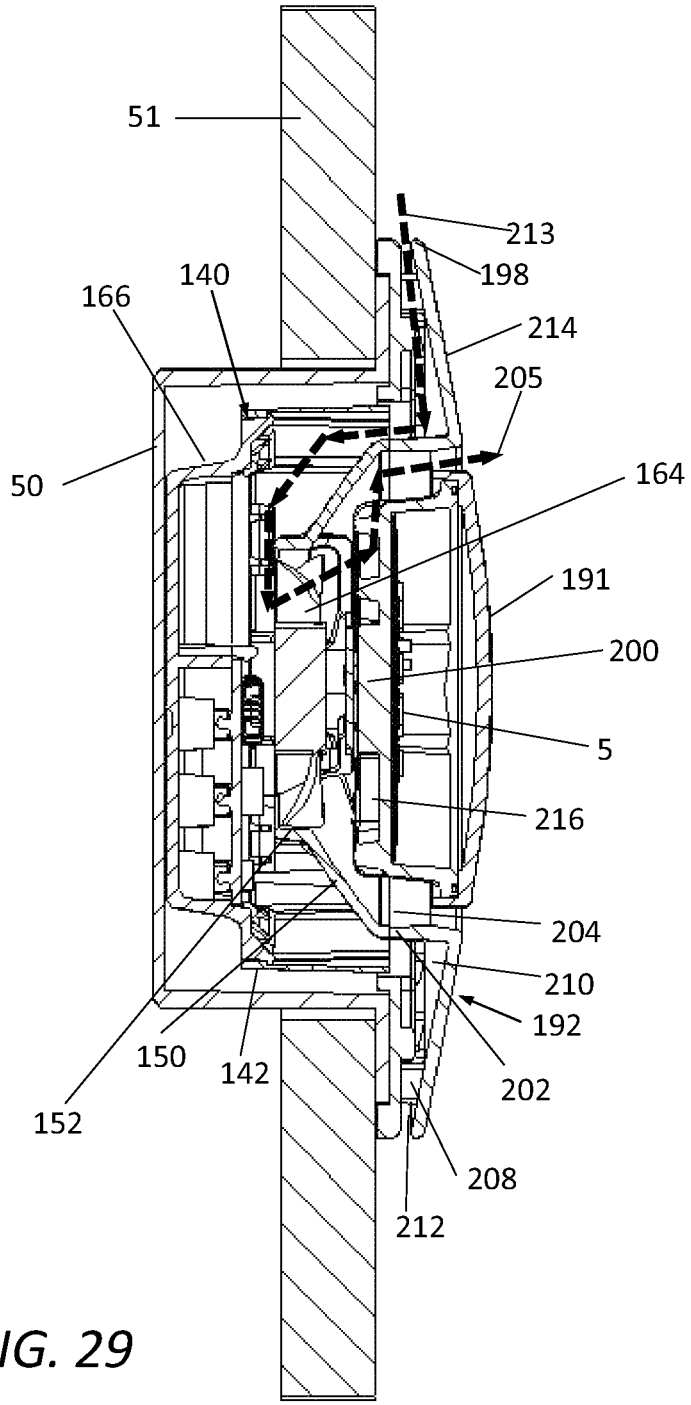
FIG. 29 is a cross-sectional view of a fourth embodiment of an LED cooling system taken along line B-B of FIG. 27 and coupled to a flat surface.

FIGS. 28 and 29 depicts cross-sectional views of a LED lighting system 190. In one or more embodiments of a heat sink 192, each sink wall 202 is adjacent to or abutting with a different one of the terminating ends 148 of the dividing wall 146 of the fan housing 140 when the heat sink 192 is coupled to the fan housing 140. In such a configuration, air exhausts from the fan housing 140 and the LED lighting system 190 through the air exhaust openings 204 upon activation of the fan 164. Furthermore, when the fan housing 140 is coupled to the heat sink 192, the end walls 142 of the fan housing 140 are positioned between the sink wall 202 and the outer periphery 198 of the heat sink 192. This allows airflow 213 to be drawn into the fan housing 140 through the outer opening 160 of the fan housing 140. Positioning of the sink wall 202 of this non-limiting embodiment is also advantageous over conventional LED lighting systems because the metal sink wall 202 separates air being exhausted from the system from air being brought into the system. Because the sink wall 202 is metal, the sink wall will absorb some of the heat of the air being exhausted from the system, meaning that it is less likely that the sink wall 202 itself will heat air entering the system.

One or more embodiments of a heat sink 192 further comprise a plurality of spacing tabs 208. The rear view of FIG. 26 and the cross-sectional views of FIGS. 28 and 29 depict non-limiting embodiments of spacing tabs 208. The plurality of spacing tabs 208 are typically protrude from the inner surface 196 of the heat sink 192 and may be arranged in an array similar to the shape of the heat sink 192. The spacing tabs 208 are typically size to interface with a protruding ring 226 on the mounting ring 220. Interfacing of the plurality of spacing tabs 208 and the protruding ring assists in removably coupling in the mounting ring 220 to the heat sink 192 and positioning the mounting ring 220 adjacent the heat sink in a most effective position. In some embodiments, when the mounting ring 220 is coupled to the heat sink 172, the spacing tabs 208 directly contact only the protruding ring 226 of the mounting ring 220 and leave a space between the remaining outer surface of the mounting ring and the spacing tabs 208. In other embodiments, the spacing tabs 208 directly contact both the protruding ring 226 and the planar portion of the outer surface of the mounting ring 220 adjacent the protruding ring 226.

One or more embodiments of a heat sink 192 further comprise mounting tabs 206. According to some aspects, the mounting tabs 206 comprise biased mounting tabs. The mounting tabs 206 are typically configured and positioned to engage with a portion of the mounting ring 220 to couple the mounting ring 220 to the heat sink 192. In the particular embodiment depicted in FIGS. 23 and 26, the mounting tabs 206 are positioned and configured to partially engage with an inner periphery 228 of the mounting ring 220, the inner periphery surrounding the fan housing opening 222 of the mounting ring 220. The mounting tabs 206 may comprise any mounting tab known in the art configured to engage with the mounting ring 220 to removably couple the mounting ring 220 to the heat sink 192.

According to some aspects, the heat sink 192 comprises a sloped portion 214 from the outer periphery 198 towards the platform 200. The sloped portion 214 allows for a greater volume of air adjacent the outer opening 160 of the of the fan housing 140 and adjacent the sink wall 202, thus improving efficiency of air entering the fan housing 140 while preventing the outer periphery 198 of the heat sink 192 from being positioned to far from the surface to which it is mounted. As previously noted, when the fan housing 140 is coupled to the heat sink 192, the end walls 142 of the fan housing 140 are positioned between the sink wall 202 and the outer periphery 198 of the heat sink 192 with the outer opening 160 of the fan housing 140 being positioned over a portion of the heat sink 192. This allows air to be drawn into the fan housing 140 from the area adjacent the sink wall 202 through the outer opening 160 of the fan housing 140.

One or more embodiments of a heat sink 192 further comprise one or more outer ribs 210 positioned on the inner surface 196 of the sloped portion 214. The outer ribs 210 are typically positioned to improve airflow 213 through the air intake opening 212 and into the outer opening 160 of the fan housing 140. One or more embodiments of a heat sink 192 further comprise a plurality of arced ribs 216 protruding from the platform 200. The arced ribs 216 are positioned to enhance airflow as the fan 164 directs air onto the platform 200, thus improving the efficiency of cooling of the heat sink.

Various embodiments of a LED lighting assembly 190 further comprise a mounting ring 220 (shown in FIGS. 23 and 25) configured to removably couple to the heat sink 192 and also removably couple the LED lighting system 190 to a J-Box 50. According to some aspects, a mounting ring 220 comprises a fan housing opening 222, one or more screw holes, a protruding ring 226, and an inner periphery 228 surrounding the fan housing opening 222.

The fan housing opening 222 of the mounting ring 220 is typically sized to allow at least a portion of the fan housing 140 to fit within the fan housing opening 222. As noted elsewhere, the fan housing opening 222 is bordered by an inner periphery 228 that is positioned and configured to interface with one or more mounting tabs 206 of a heat sink 192 to removably couple the heat sink 192 to the mounting ring 220. In some embodiments, the inner periphery 228 comprises a lip protruding from a surface of the mounting ring 220. A protruding ring may also extend from a surface of the mounting ring 220, the protruding ring being positioned to interface with one or more of the spacing tabs 208 of the heat sink 192.

One or more embodiments of a mounting ring 220 further comprise a plurality of screw holes. The mounting ring 220 typically comprises at least two first screw holes 223 positioned to align with two screw holes of a first sized J-Box 50 to allow easy and convenient coupling of the mounting ring 220 to the J-Box 50. The mounting ring 220 may further comprise at least two second screw holes 224 positioned to align with two screw holes of a second sized electrical junction box. The mounting ring 220 may further comprise at least two third screw holes 225 positioned to align with two screw holes of a third sized electrical box. Thus, the mounting ring 220 is configured to allow coupling of the LED lighting system 190 to a variety of sized electrical junction boxes common in the art of junction boxes. The mounting ring 220 may further comprise additional screw holes positioned to align with screw holes on any of the heat sinks disclosed herein to removably couple the respective heat sink to the mounting ring 220. It is further contemplated that spacing tabs 208 may extend from the outer surface of the mounting ring in alternative or addition to the spacing tabs 208 of the mounting ring 220.

Embodiments of a LED lighting assembly 190 further comprise an air intake opening 212. According to some aspects, one or more air intake openings are formed between the heat sink 192 and the mounting ring 220 when the heat sink 192 and the mounting ring 220 are coupled together. More particularly, one or more air intake openings are formed between the inner surface 196 of the heat sink 192 and the outer surface of the mounting ring 220. Positioning of the spacing tabs 208 extending from the inner surface 196 of the heat sink 192 may assist in direct air flow through the LED lighting system 190 upon activation of the fan 164.

FIG. 28 depicts a cross-sectional view of a non-limiting embodiment of a LED lighting assembly 190 coupled to a J-Box 50, and FIG. 29 depicts a cross-sectional view of a non-limiting embodiment of a LED lighting assembly 190 coupled to a J-Box 50 and mounted to a flat surfaced 51. In operation, the LED light system 190 improves the cooling efficiency of the system in comparison to conventional LED lighting systems. When a fan 164 in the LED lighting system 190 is activated, airflow 213 typically enters the system through the plurality of air intake openings 212 on the heat sink 192 and passes into the outer openings 160 of the fan housing 140. Once within the fan housing 140, air passes through the fan housing apertures 162 and the airflow 205 is exhausted from the system through the air exhaust openings 204 on the heat sink 192.

Like other embodiments contemplated and disclosed herein, embodiments of a LED lighting assembly 190 are configured to mount to a flat surface 51 having a J-Box 50 mounted thereto. FIG. 29 depicts an exemplary implementation of this configuration. More particularly, according to some aspects, the mounting ring 220 may be mounted to the flat surface by coupling the mounting ring 220 to a J-Box 50. In one or more embodiments, the mounting ring 220 is coupled to the J-Box 50 with screws extending through one or more of the screw holes in the mounting ring 220 and the J-Box 50. Before or after coupling the mounting ring 220 to the electrical box, the fan housing 140, coupled to a heat sink 192, may be partially inserted into the fan housing opening 222 of the mounting ring 220. Wires within the J-Box 50 may be operably coupled to the circuit board 168 of the fan housing cover 168 at any point, as will be apparent to one having ordinary skill in the art.

FIGS. 30-38 depict various other non-limiting embodiments of a fan cooled LED lighting system 230. As depicted in the exploded perspective view of FIG. 38 and according to some aspects, an LED lighting system 230 comprises a heat sink 232, one or more LEDs coupled to an outer surface 234 of the heat sink 232, an LED cover 231 coupled to an outer surface 234 of the heat sink 232, a fan housing 250 coupled to the heat sink 232 opposite the LED 5, and a cover 270 coupled to the fan housing 250 distal the heat sink 232. In one or more embodiments, the cover 270 threadedly couples to a threaded portion 243 of the heat sink 232. An O-ring 241 may be utilized to improve the seal between the heat sink 232 and the cover 231.

Figure 35:
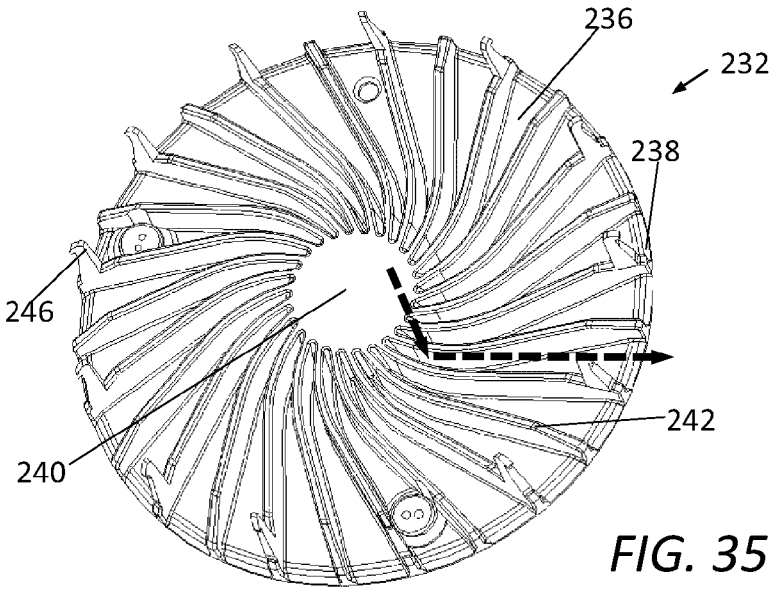
FIG. 35 is a rear perspective view of a fifth embodiment of a heat sink.

FIG. 35 depicts a rear view of a non-limiting embodiment of a heat sink 232. In one or more embodiments, a heat sink 232 comprises a plurality of ribs 242 extending from an outer periphery 238 of the heat sink 232 towards a center 240 of the heat sink 232. In some embodiments, the plurality of ribs 242 extend all the way from the outer periphery 238 of the heat sink 232 to the center 240 of the heat sink 232 where they meet at a raised center portion. In other embodiments, the plurality of ribs 242 extend only part way from the outer periphery 238 toward the center 240 of the heat sink 232. In still other embodiments, the plurality of ribs 242 extend only part way between the outer periphery 238 and the center 240 of the heat sink 232. According to some aspects, the plurality of ribs 242 may be either arced or straight.

One or more embodiments of a heat sink 232 further comprising a plurality of coupling posts 246. According to some aspects, the plurality of coupling posts 246 extend from the inner surface 236 of the heat sink 232. According to other aspects, the plurality of coupling posts 246 each extend from a different on of the plurality of ribs 242. The coupling posts 246 are configured to couple the heat sink 232 to the fan housing 250. In some embodiments, each coupling post 246 comprises a head configured to engage with a receiver on the fan housing 250.

Figure 33:
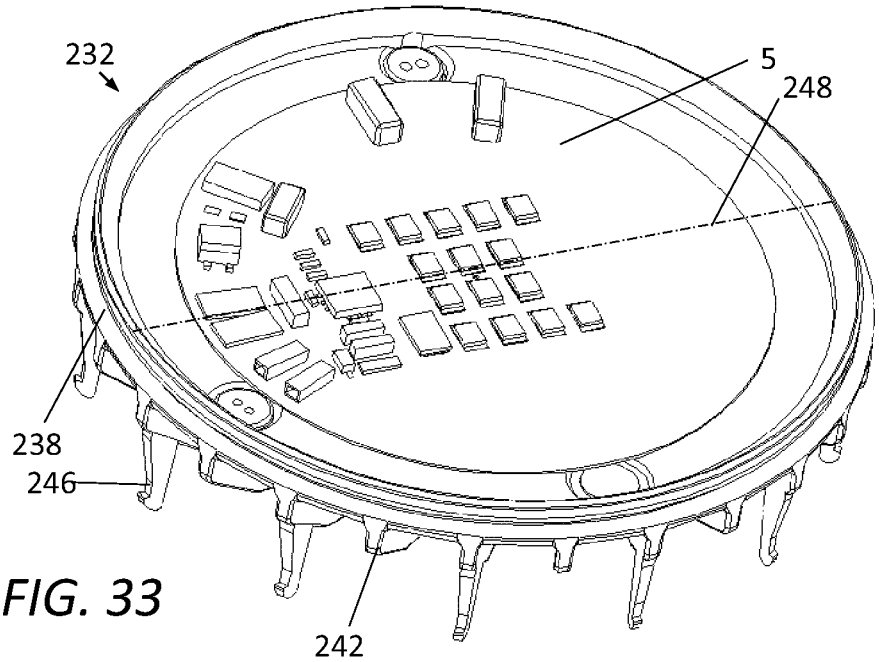
FIG. 33 is a front perspective view of a fifth embodiment of a heat sink.

FIG. 33 depicts a front view of a non-limiting embodiment of a heat sink 232. Embodiments of the heat sink 232 may comprise any of a variety of shapes. In the non-limiting embodiment depicted in FIG. 33, the heat sink 232 comprises a substantially circular shape having a first diameter 248.

Figure 34:
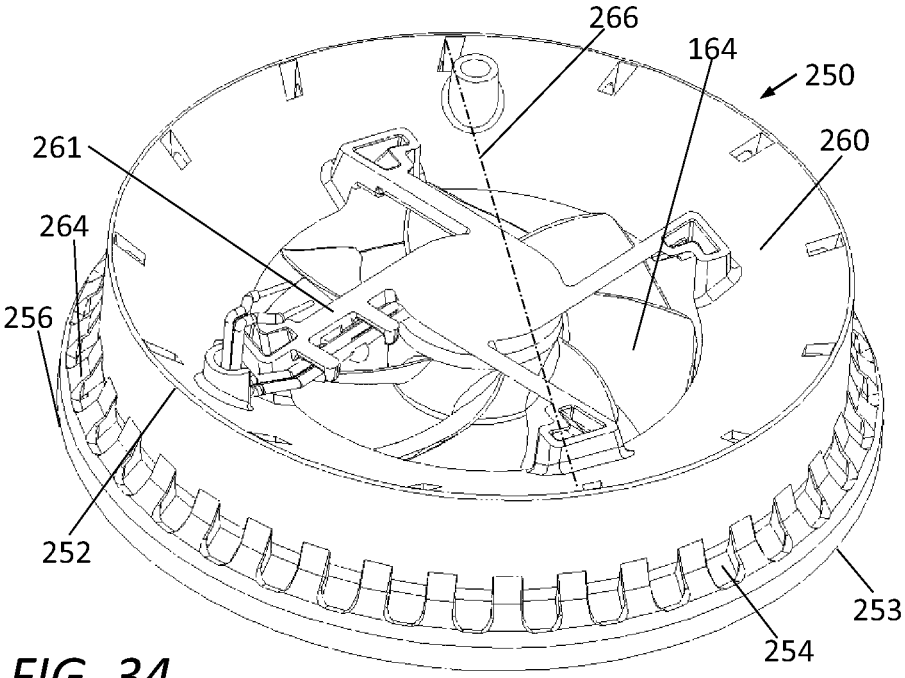
FIG. 34 is a front perspective view of a fifth embodiment of a fan housing.
Figure 36:
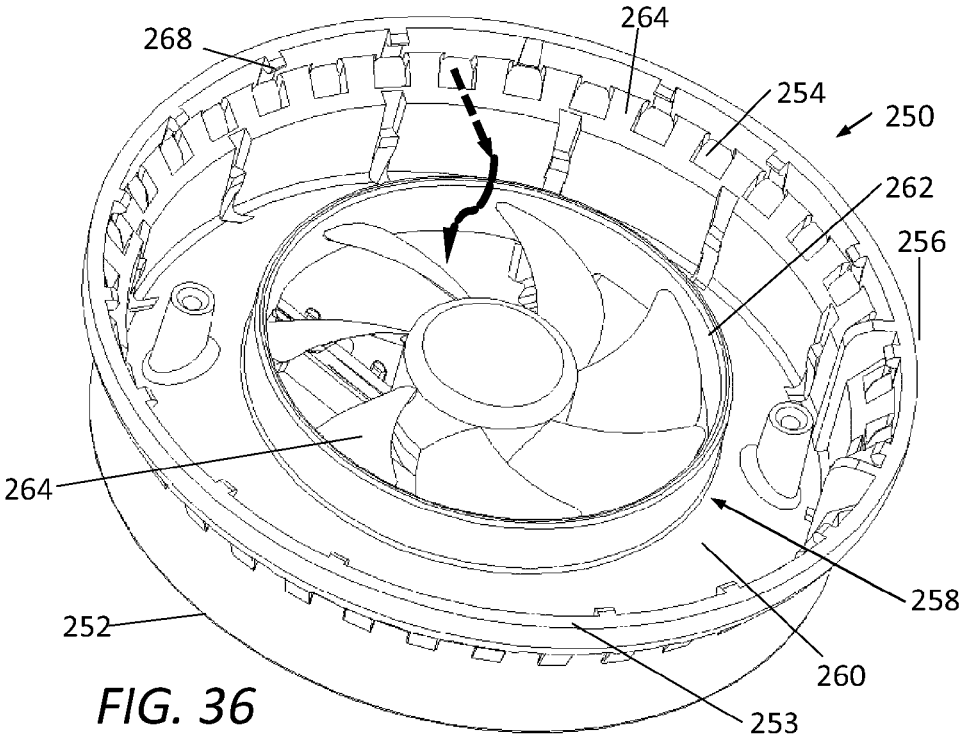
FIG. 36 is a rear perspective view of a fifth embodiment of a fan housing.

One or more embodiments of a LED lighting system 230 further comprise a fan housing 250 coupled to the heat sink 232 opposite the LED 5. FIGS. 34 and 36 depict a front and rear view, respectively, of a non-limiting embodiment of a fan housing 250. The fan housing 250 is typically coupled to the heat sink 232 at a first end 252 of the fan housing 250. The fan housing 250 may be coupled to the heat sink 232 through any coupling mechanism known in the are, such as but not limited to threaded coupling, screws, adhesives, posts, and the like. In the particular non-limiting embodiment depicted in FIGS. 30-33, the fan housing 250 is coupled to the heat sink 232 with the coupling posts 246 extending from the heat sink 232. In such embodiments, each coupling post 246 extends through a post hole in the base of the fan housing 250 and engages with a post receiver on the fan housing 250. According to some aspects, a head of the post coupling 246 engages with a slotted or recessed post receiver on the fan housing 250.

The fan housing 250 may comprise any of a variety of shapes and configurations. In the non-limiting embodiment depicted in FIGS. 34 and 36, the fan housing 250 is substantially cylindrical in shape. In one or more embodiments, the fan housing 250 comprises a second diameter 266 at a first end 252 that is substantially equal to the first diameter 248 of the heat sink 232.

One or more embodiments of a fan housing 250 further comprising at least one air intake opening 254 on an outer periphery 238 of the fan housing 250. The air intake openings 254 are typically distal the heat sink 232 and extend through the fan housing 250 to allow fluid communication between the inside and outside of the fan housing 250. In particular embodiments, the air intake openings 254 extend through an angled portion 264 of the fan housing 250. Positioning the air intake openings 254 on an angled portion 264 creates a greater surface area of each of the air intake openings 254, thus allowing more air from outside the fan housing 250 to be brought into the fan housing 250 upon activation of the fan 164.

Figure 37:
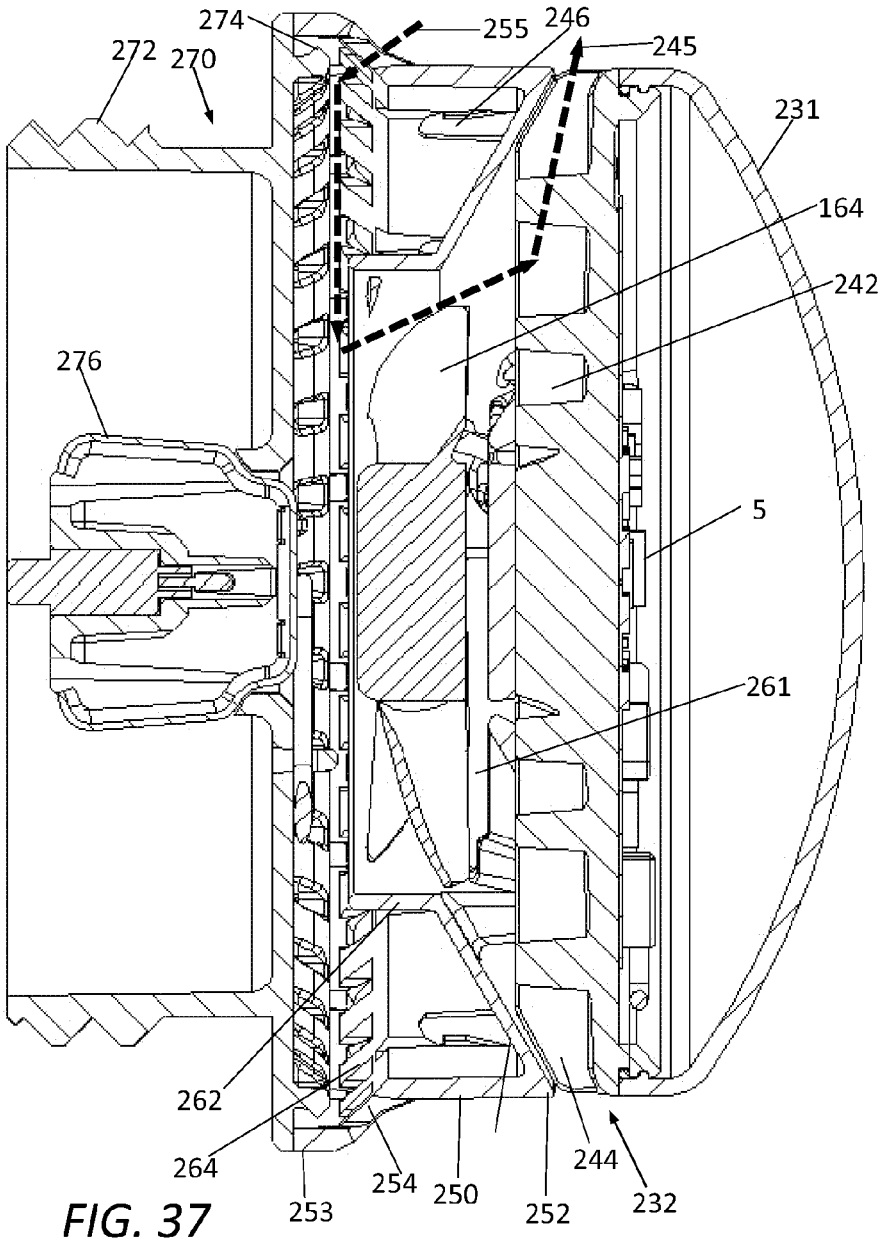
FIG. 37 is a cross-sectional side view of a fifth embodiment of an LED cooling system taken along line C-C of FIG. 30.
Figure 38:
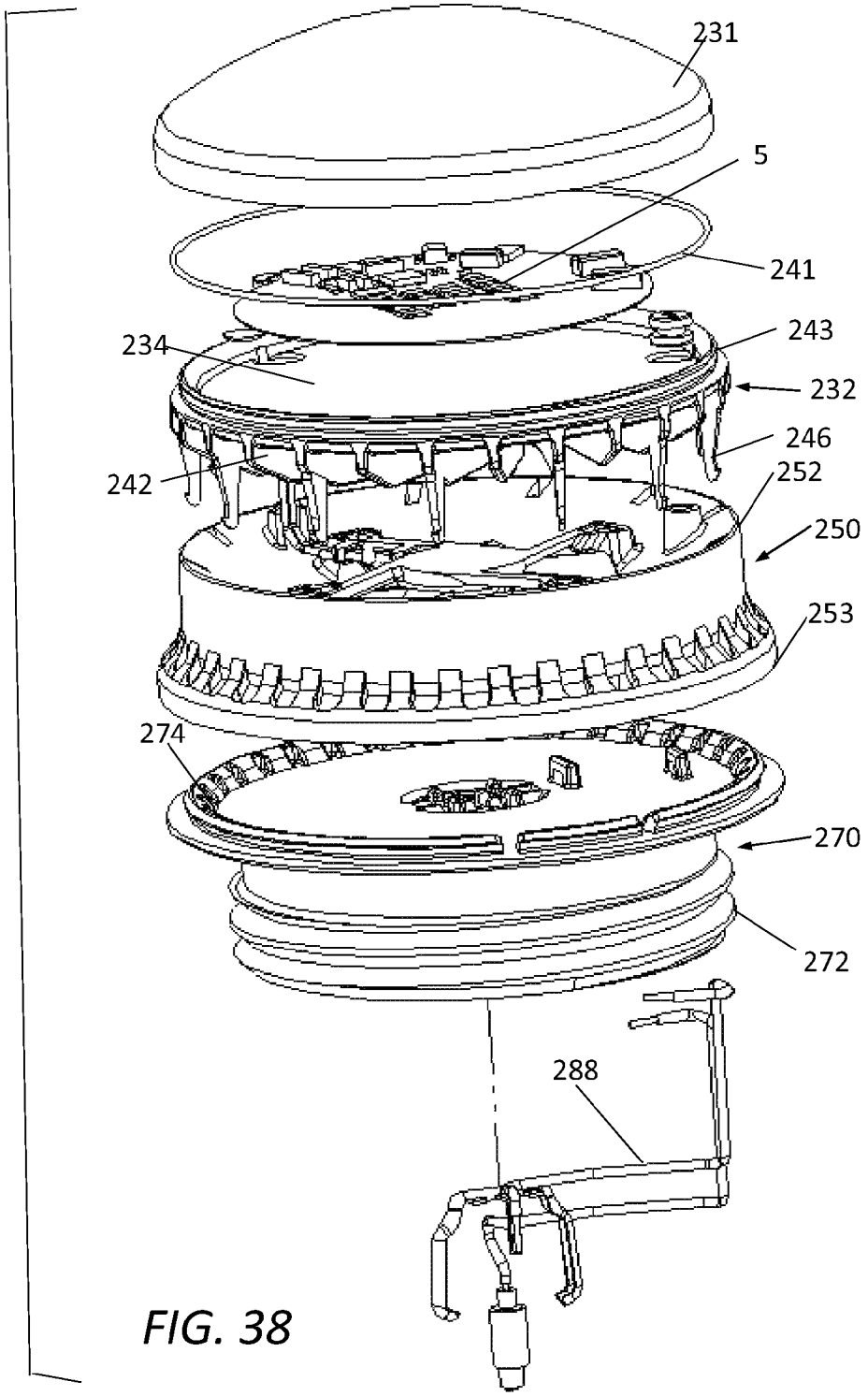
FIG. 38 is an exploded view of a fifth embodiment of an LED cooling system.

Coupling of the fan housing 250 to the heat sink 232 creates one or more air exhaust openings 244 between the first end 252 of the fan housing 250 and the outer periphery 238 of the heat sink 232. FIG. 37 depicts a cross-sectional view of a non-limiting embodiment of a LED lighting system 230. Responsive to activation of the fan 164 in the fan housing 250, airflow 255 enters the fan housing 250 through the air intake openings 254 and across a portion of the heat sink 232. Airflow 245 exits the LED lighting system 230 through the plurality of air exhaust openings 244. Positioning of the arced ribs 242 on the heat sink 232 may more efficiently direct air to the air exhaust openings 244 on the outer periphery 238 of the heat sink 232.

Figure 30:
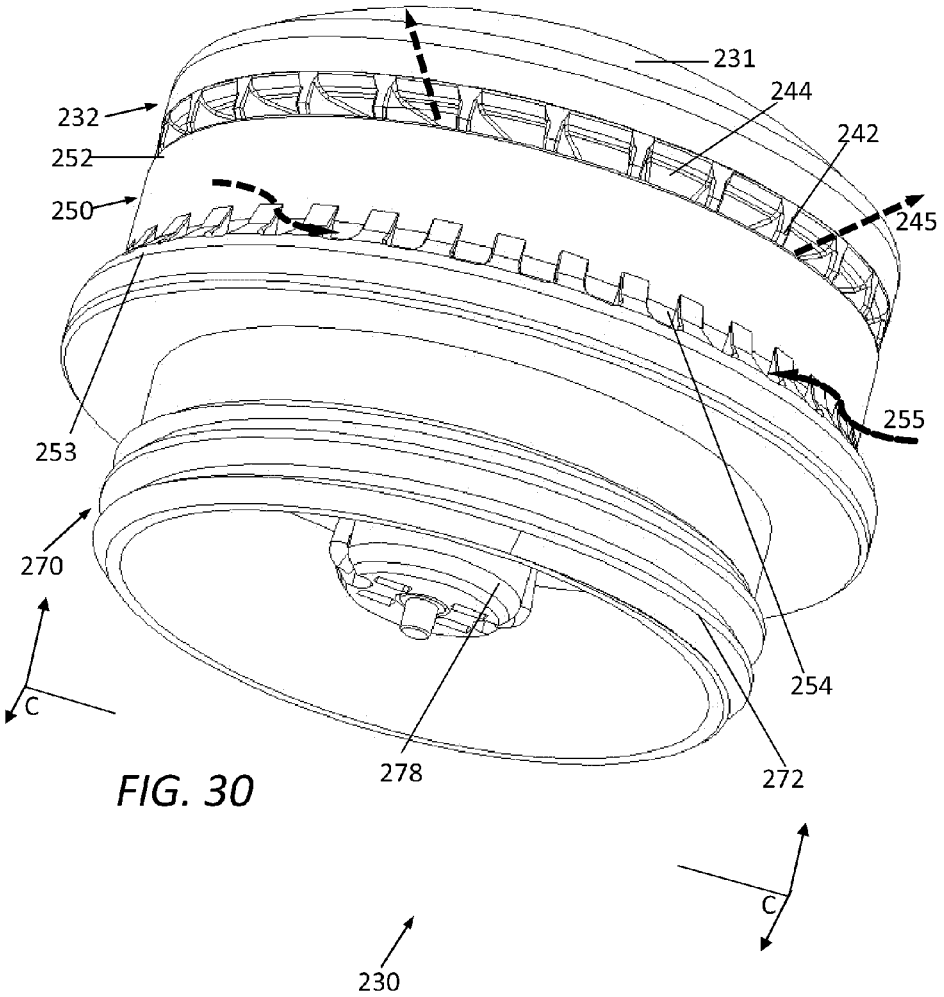
FIG. 30 is a rear perspective view of a fifth embodiment of an LED cooling system coupled a first cover.
Figure 31:
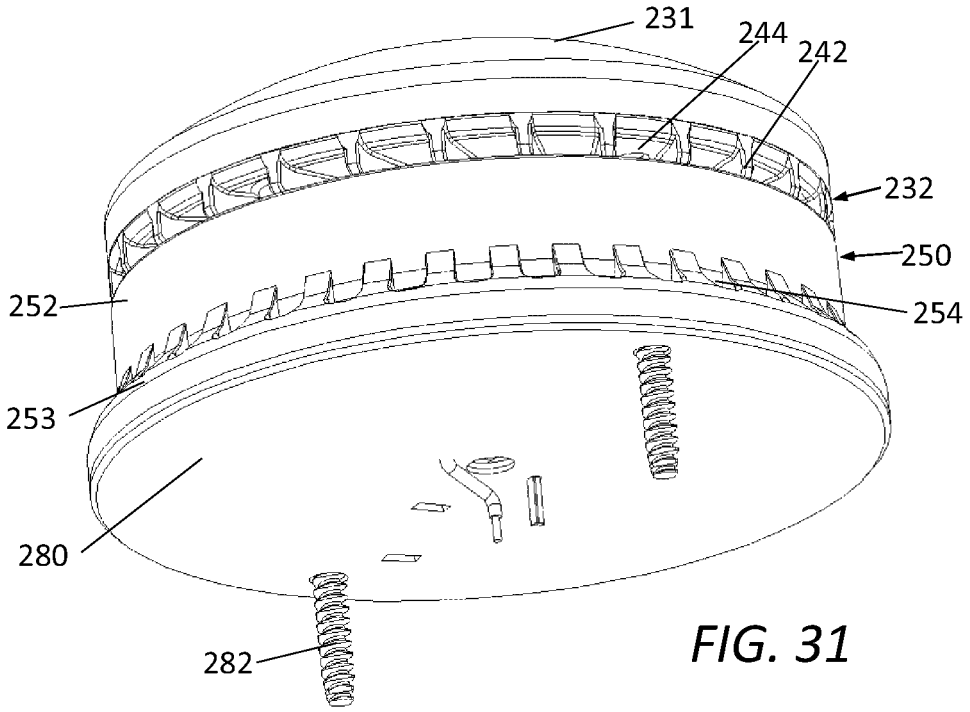
FIG. 31 is a rear perspective view of a fifth embodiment of an LED cooling system coupled to a second cover.
Figure 32:
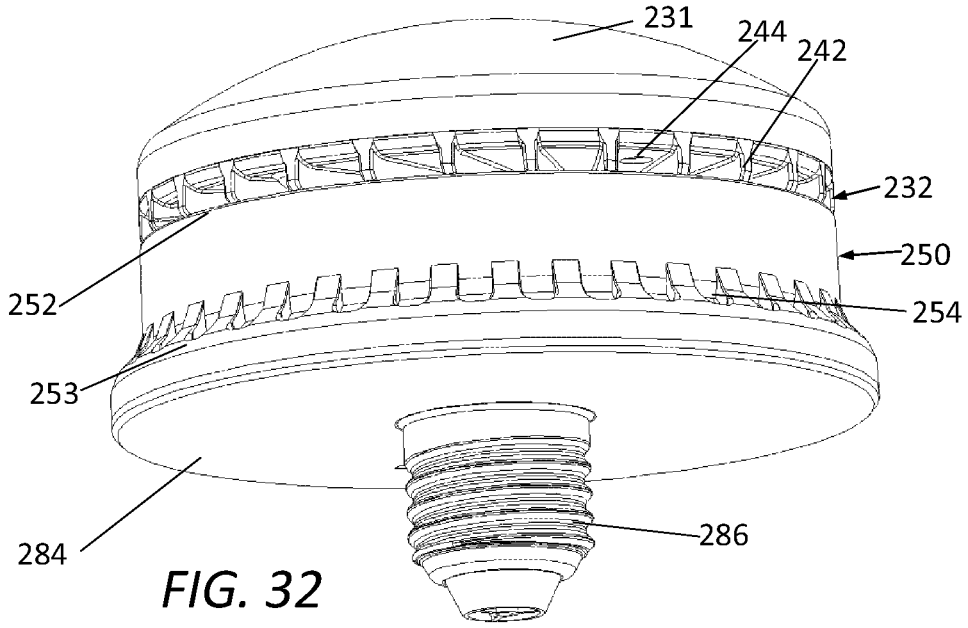
FIG. 32 is a rear perspective view of a fifth embodiment of an LED cooling system coupled to a third cover.

One or more embodiments of a LED lighting system 230 further comprise a cover coupled a second end 253 of the fan housing 250 distal the first end 252. FIGS. 30-32 depict perspective views of LED lighting systems coupled to different covers. In FIG. 30, the cover 270 comprises a threaded portion 272 configured to removably couple the LED lighting system 230 to the base of a common jelly jar light. The cover 270 further comprises a fitting element 278. The fitting element 278 is configured to operably couple to the power source in the base of the jelly jar light and is operably coupled to the LED 5 and the fan 164. According to some aspects, the fitting element 278 comprising a spring coupling the couples to the sides walls of the power source of the base of the jelly jar light, and a pogo-pin on the fitting element may further couple to the bottom of the power source of the base of the jelly jar light. The two then combine to make a complete electrical circuit that brings power to the LED lighting system 230.

FIG. 31 depicts another embodiment of a cover 280 for use in a LED lighting system 230. According to some aspects, a cover 280 is substantially planar on a rear surface and is adapted to couple to a flat surface or a J-Box 50. Accordingly, screws 282 are configured to extend through the cover 280 to removably couple the cover 280 and LED lighting system 230 to a J-Box 50 and or a flat surface. The screws may be inserted prior to coupling of the housing 250 to the cover 280 or, alternatively, the dividing wall 258 may comprise openings that allow access to the screws 282. The cover 280 may comprise a hole or other wiring to allow for operably coupling of the LED lighting system to a power source.

FIG. 32 depicts another embodiment of a cover 284 for use in a LED lighting system 230. One or more embodiments of a cover 284 comprise a fitting element 286 configured to operably and removably couple to the LED lighting system 230 to a conventional light bulb socket.

Coupling of the various covers 270, 280, 284 to the fan housing 250 may be through any mechanism known in the art, such as but not limited to threaded coupling, adhesives, screws, pins, and the like. In the non-limiting embodiment depicted in FIG. 38 the cover 270 comprises a plurality of tab receivers 274 configured to receiver a plurality of tabs 268 on the fan housing 250 to couple the fan housing 250 to the cover 270. The covers 280 and 284 may include similar tab receivers 274. According to some aspects, the tabs 268 are proximate the second end 253 of the fan housing 250. The tab receivers 274 may comprise any configuration for receiving the tabs 268 and to hold the cover 270 either temporarily or permanently in place. The covers 270, 280, 284 may be configured to be interchangeable with the LED lighting system 230, thus allowing a user to adapt the LED lighting system 230 for particular uses.

Typically housed within the fan housing is a fan 164. The fan 164 may comprise any fan known in the art. In the non-limiting embodiment depicted in FIG. 36, the fan 164 is mounted to a dividing wall 258. The dividing 258 is configured to position the fan 164 within the fan housing 250 such that the fan 164, when activated, may draw air into the fan housing 250 through the air intake openings 254 and exhaust air through the air exhaust openings 244. According to some aspects, the dividing wall 258 comprises a sloped body 260 and a rim 262. The sloped body 260 is typically partially conical in shape the rim 262 is typically circular or cylindrical in shape. In such embodiments, the fan 164 is typically mounted to fit within the rim 262, the fan being supported by a fan mount 261. In operation, embodiments of the LED lighting system 230 are configured to efficiently draw air into the fan housing 250 through the air intake openings 254, then blow that air onto the heat sink 232 before air is finally exhausted through the air exhaust openings 244. In so doing, the LED lighting system 230 is cooled more efficiently than conventional LED lighting assemblies.

It is noted that throughout this disclosure, reference is made to various air intake openings and air exhaust openings. Also contemplated in this disclosure, however, are systems wherein the direction of air flow is reversed dependent upon the rotational direction of the fan. Thus, it is understood that any air exhaust opening may also be air intake openings, and any air intake openings may be air exhaust openings.

FIG. 2A is a schematic diagram that shows an embodiment of an LED light bulb device or LED device 40 according to an embodiment of the present disclosure. LED device 40 includes an AC/DC convertor further comprising an AC LED Driver integrated circuit (IC) or semiconductor chip 42. AC LED Driver IC 42 includes a line input 44 and a neutral input 46. The line input 44 and neutral input 46 can receive a standard AC voltage, such as 120 volts from a standard US electrical socket. AC LED Driver IC 42 converts the AC voltage to a desired DC output, such as 4 volts, 12 volts, or any other desired voltage, at output 48. LED Driver IC 42 converts the AC voltage across inputs 44 and 46 to a DC voltage at output 48 by employing a bank switching scheme that effectively "chops up" the AC input signal by processing discrete portions of the AC signal with respect to a time domain of the signal. By using the "chopped" AC signal from inputs 44 and 46, LED Driver IC 42 functionally replaces a much larger number of hardware components that might otherwise be used to accomplish an AC/DC conversion such as is required by a conventional AC/DC converter. Specifically, a single semiconductor chip can replace on the order of 50 or more components that would be required by a conventional AC/DC converter to provide similar functionality, thereby greatly simplifying the circuitry for LED device 40. As a non-limiting example, LED Driver IC 42 may include, without limitation, such chips as the chip of part number DT3001A/B by Digital Media Bridge Technology Co., Ltd. (DMB). DMB chip DT3001A/B is used, for example, by SEOUL Semiconductor as part of a bank switching scheme that effectively "chops up" an AC input signal to provide a desired output signal to an array or plurality of LEDs as used in Acrich Semiconductor Eco Lighting, such as the Acrich 4 W, 8 W, and 12 W Acrich 2 modules. Use of bank switching for an LED lighting module is disclosed in U.S. Pat. No. 7,081,722 to Huynh, et al, titled "LIGHT EMITTING DIODE MULTIPHASE DRIVER CIRCUIT AND METHOD," as well as U.S. Pat. No. 7,439,944, to Huynh, et al, titled "LIGHT EMITTING DIODE MULTIPHASE DRIVER CIRCUIT AND METHOD," the entirety of the disclosures of which are incorporated herein by this reference.

Advantageously, use of AC LED Driver IC 42 in place of a conventional AC/DC convertor comprising numerous hardware components also increases reliability of the AC/DC conversion process. For example, conventional AC/DC convertors may include buck convertors, boost convertors, buck boost converters, H Bridge converters, SEPIC converters, Flyback converters, and a number of capacitors, transformers and inductors, each of which includes a functional life-time. Elements of a conventional AC/DC convertor can fail after a period of normal use also causing the convertor to fail. For example, conventional AC/DC convertors can receive repeated spikes in voltage during normal operation. The spikes in voltage can be reduced or smoothed for the convertor by capacitors, which can fail after receiving repeated spikes in voltage. Thus, by using AC LED Driver IC 42 in place of a conventional AC/DC convertor as part of LED device 40, a simpler, more reliable, and less expensive solution is available.

Figure 39A:
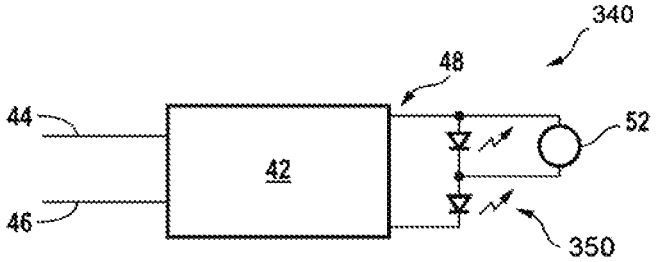
FIGS. 39A and 39B are schematic diagrams that illustrate LED devices comprising fans.

FIG. 39A further shows a number of LEDs 350 are coupled to AC LED Driver IC 42 at output 48 to receive a desired DC voltage for powering LEDs 350. LEDs 350 may be a single LED or a plurality of LEDs arranged in an array comprising multiple banks of LEDs connected in series or in parallel, as discussed in greater detail below with respect to FIG. 40. Additionally, FIG. 39A shows a DC powered variable speed fan 52 that is coupled to output 48 of AC LED Driver IC 42 and is further coupled in parallel with at least one LED 350. The design of LED device 40 is conducive to the use of DC powered fans, which are typically commercially available as fans with a longer service lives than commercially available AC fans. In an embodiment, fan 52 is a fan produced by Sunon, Inc. The design of LED device 340 advantageously provides DC power for both LEDs 350 and fan 52 using the same AC LED Driver IC 42; thereby increasing efficiency by eliminating the redundancy of multiple AC/DC convertors for a single LED device, such as may be required by certain conventional designs. Additionally, by coupling fan 52 in parallel with LEDs 350, instead of coupling the fan at a separate output of an AC LED Driver IC as is common with certain prior art designs, the voltage of fan 52 may vary as a voltage of LEDs 350 varies. A voltage to LEDs 350 may vary to increase a brightness or amount of light emitted by the LEDs. For example, LEDs 350 may be tied to a dimmer or have a dimmer functionality such that as voltage is increased a brightness of LEDs 350 is also increased to accommodate user preference. When fan 52 is coupled in parallel with LEDs 350, a voltage to variable speed fan 52 may also vary, to increase or decrease a speed at which the fan operates. For example, as the brightness of LEDs 350 is varied, such as by a dimmer, because LEDs 350 and variable speed fan 52 are coupled in parallel and share the same voltage, the speed of fan 52 varies directly with a brightness of LEDs 350. Advantageously, the increased brightness and heat from LEDs 350 is directly related to the speed of fan 52 and an amount of heat dissipated from LED device 340 by the fan so that the more heat is generated by LEDs 350, the more heat is dissipated by fan 52. Significantly, the direct relationship between heat generated by, and heat conducted away from, LED device 340 results from connecting LEDs 350 and fan 52 in parallel without the additional expense, complexity, and cost of adding additional components or circuitry to the LED device. Thus, the functionality of controlling the speed of fan 52 to accommodate changing thermal conditions of LEDs 350 may be "free" because variation of fan speed can operate without any circuitry or components in addition to those used for the operation of LEDs 350.

Figure 39B:
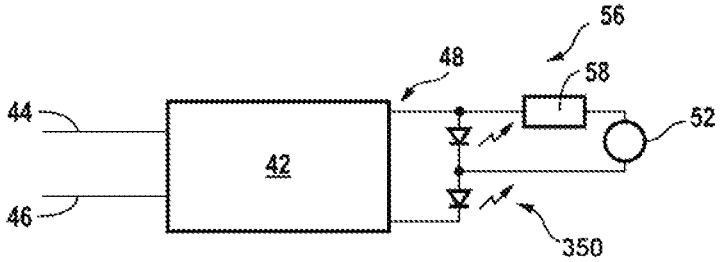
Figure 40:
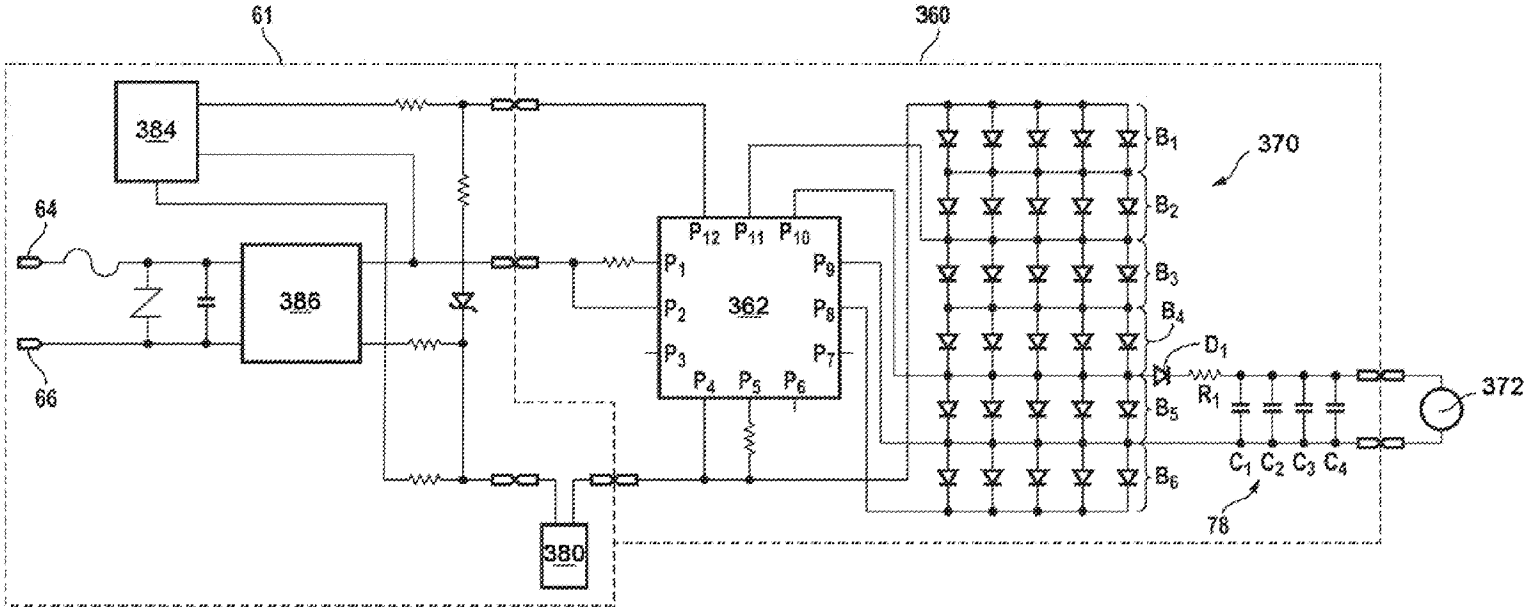
FIG. 40 is a schematic diagram that illustrates additional detail of an LED device comprising a fan.

FIG. 39B is a schematic diagram that shows an embodiment of an LED light bulb device or LED device 56 similar to LED light bulb device or LED device 340 from FIG. 39A. LED device 56 differs from LED device 340 by inclusion of optional filter 58. Filter 58 may include a number of capacitors and provides a stable voltage to fan 52 that may reduce or effectively eliminate undesired ripple effects and may also provide a voltage to fan 52 different from the voltage provided to LEDs 350, if desired. In one embodiment, a voltage of between 11.8-12.2 V may be used depending upon the fan being used for the design. However a different voltage could equivalently be used for a different fan, or if the forward voltage of the LEDs used is changed. Those of ordinary skill in the art will readily understand how to modify FIG. 40 is a schematic diagram that shows an embodiment of an LED circuit module 360 coupled to circuitry 61 and fan 372 in an arrangement similar to LED light bulb device or LED device 56 from FIG. 39B. LED circuit module 360 includes an AC/DC convertor further comprising an AC LED Driver IC, semiconductor chip, or IC 362 similar to AC LED Driver IC 42. IC 362 may be coupled to a line input 64 and a neutral input 66 that provide power for LED circuit module 360. Line input 64 and neutral input 66 may receive a standard AC voltage, such as 120 volts from a standard US electrical socket. IC 362 converts the AC voltage to a desired DC output, such as 4 volts, 12 volts, or any other desired voltage, at a number of output interconnects or pins. IC 362 may include any number of input/output pins or interfaces, and in a non-limiting embodiment comprises twelve pins, P1 to P 12. As described above with respect to AC LED Driver IC 42, IC 362 may convert the AC voltage across inputs 64 and 66 to a DC voltage by employing a bank switching scheme that effectively "chops up" the AC input signal by processing discrete portions of the AC signal with respect to a time domain of the signal. By using the "chopped" AC signal from inputs 64 and 66, LED Driver IC 362 functionally replaces a much larger number of hardware components that might otherwise be used to accomplish an AC/DC conversion such as is required by a conventional AC/DC converter. Specifically, a single semiconductor chip may replace on the order of 50 or more components that would be required by a conventional AC/DC converter to provide similar functionality, thereby greatly simplifying the circuitry for LED circuit module 360. As indicated above, IC 362 may include the chip of part number DT3001A/B by DMB that is used by SEOUL Semiconductor as part of its Acrich Semiconductor Eco Lighting hardware. Advantageously, use of IC 362 in place of a conventional AC/DC convertor comprising numerous hardware components also increases reliability of the AC/DC conversion process.

FIG. 40 further shows a number of LEDs 370 are arranged as a grid or array comprising a number of banks or rows B1 to B6, although any number of banks or rows comprising LEDs 370 arranged in series or parallel may be formed. One or more banks B1 to B6 of LEDs 370 are coupled to a number of pins P1-P12 of IC 362 such that LEDs 370 are configured to alternately receive a desired DC voltage from IC 362 for powering LEDs 370. For example, banks B1 and B2 may be coupled to P4, P5, and P11 of IC 362, banks B3 and B4 may be coupled to P10 and P11 of IC 362, bank B5 may be coupled to P9 and P10 of IC 362, and bank B6 may be coupled to P8 and P9 of IC 362. By controlling an amount and time for which the DC voltage is alternatingly applied across the various pins of IC 362, banks of LEDs 370 are alternately illuminated. While LEDs 370 are shown in FIG. 40 as organized in parallel rows or banks, LEDs 350 may also be serially arranged and/or packaged in groups that appear to be single lights, which are in reality, composed of a group or number of LEDs 350. In an embodiment, each bank of LEDs may be independently controlled by IC 362, which allows for more control over the operation of LEDs 370 than would otherwise be available with a more complex AC/DC conversion circuit that did not use an IC like IC 362. Because the banks of LEDs 370 are alternately turned on and off, during normal operations, an entirety of the lights is not on at a same time. However, the switching on and off of LEDs 370 may occur so quickly that a user does not perceive any flickering or perceive that LEDs 370 are being turned on and off, and instead perceives that the entirety of LEDs 370 are continuously activated or on. By using IC 362 to vary an electrical load supplied to a combination of banks B1-B6, arranged in series or parallel, a high power factor can be achieved for LEDs 370 in banks B1-B6. As known in the art, a power factor is a dimensionless unit used to describe a ratio of: real power flowing to the electrical load/apparent power; wherein real power is a circuit's capacity for performing work and apparent power is the product of the current and voltage of the circuit. In an embodiment, a power factor in a range of 0.9-1.0 is achieved by using IC 362 as described above.

Additionally, FIG. 40 shows a DC powered variable speed fan 372, similar to fan 52 from FIGS. 39A and 39B, coupled to bank B5 of LEDs 370 and further coupled to pins P9 and P10 of IC 362. By coupling fan 372 in parallel with at least one LED 370 the design of LED circuit module 360 advantageously provides DC power for both LEDs 370 and fan 372 using the same IC 362; thereby increasing efficiency by eliminating the redundancy of multiple AC/DC convertors for a single LED device. Additionally, by coupling fan 372 in parallel with bank B5 of LEDs 370, the voltage of fan 372 may vary as a forward voltage to LEDs 370 varies. A voltage to bank B5 of LEDs 370 may vary to increase a brightness or amount of light emitted by the LEDs. For example, LEDs 370 may receive a voltage from IC 362 that varies to dim or brighten LEDs 370 to accommodate user preference. Because LEDs 370 are coupled in parallel with fan 372, a voltage to variable speed fan 372 may also vary, to increase or decrease a speed at which the fan operates. For example, as the brightness of LEDs 370 is varied, because LEDs 370 and variable speed fan 372 are coupled in parallel and share the same voltage, the speed of fan 372 varies directly with a brightness of LEDs 370. Advantageously, the increased brightness and heat from LEDs 370 is directly related to the speed of fan 372 and an amount of heat dissipated from LED circuit module 360 by the fan so that when more heat is generated by LEDs 370, more heat is dissipated by fan 372. Significantly, the direct relationship between heat generated by, and heat conducted away from, LED circuit module 360 results from coupling LEDs 370 and fan 372 in parallel. Thus, the functionality of controlling the speed of fan 372 to accommodate changing thermal conditions of LEDs 370 may be "free" because variation of fan speed may operate without any additional, or only nominal, circuitry and components in addition to those used for the operation of LEDs 370. In an embodiment, the forward voltage of LEDs 370 may be approximately 24 volts and fan 372 is rated for 24 volts. In another embodiment, LEDs 370 may operate at a switching forward voltage peaking at a range of approximately 18-20 volts and a filter, such as filter 78 described in greater detail below, may be used to change the switching forward DC voltage from 18-20 volts to a DC voltage of approximately 12 volts.

Additionally, conventional LED light devices typically are made such that all the LEDs are connected or tied off together, whether in series or in parallel, so if an additional component such as fan 372 were coupled to the LEDs, the electrical current drawn by the component would reduce electrical current available for the connected group of LEDs, thereby sacrificing performance of the LEDs. To the contrary, by dividing the plurality of LEDs 70 into separate banks of LEDs that are independently controlled by IC 362, drawing power from one bank of LEDs, such as B5, does not adversely affect the performance of adjacent banks of LEDs in a significant or substantial way, although some nominal change in current and/or voltage may occur in surrounding banks of LEDs. Thus, the banks of LEDs may be arranged such that a voltage that would otherwise be supplied to a portion of the LEDs may be directed to power fan 372 by tapping off one bank of LEDs 70 to provide power to fan 372. Therefore, in a non-limiting exemplary embodiment, modification of IC 362 for use with multiple banks of LEDs 370 requires a small number of parts (approximately 5-10 parts) and requires a small cost for parts (approximately $0.05-$0.20).

FIG. 40 further shows LED circuit module 360 may optionally include a filter 78, similar to filter 58 in FIG. 2B. Filter 78 is coupled between bank B5 of LEDs 370 and fan 372, and may optionally include a diode Dl, a resistor R1, and a number of capacitors C1-C4. Resistor R1 may be used to adjust a voltage supplied to fan 372 as part of filter 78. The supply voltage to fan 372 is based on the forward voltage of LEDs 370 to which the fan is coupled, for example bank B5 of the LEDs. Accordingly, an operating voltage of LEDs 370 and fan 372 may be matched and may correspond one to another. For example, if the forward voltage of LEDs 370 is 24 volts, a 24 volt rated fan 372 may be selected. Similarly, LEDs operating at 12 volts may be paired with a 12 volt rated fan. In some embodiments, an optimal operating voltage for LEDs 370 will be different from an optimal operating voltage of fan 372, in which case allowance should be made for the differences in voltage by adjusting the voltage between LEDs and the fan by inserting a resistor, such as R1, between the LEDs and the fan. In a particular embodiment, LEDs 370 operate at a peak switching forward voltage in a range of approximately 18-20 volts and fan 372 is rated to operate at approximately 12 volts, so that filter 78 including resistor R1 is used to change the DC voltage of 18-20 volts at B5 of LEDs 370 to a voltage of about 12 volts at fan 372. In an embodiment, resistor R1 may have a resistance sized to meet the current requirements of the fan. In a particular embodiment, resistor R1 may have a value of about 150 ohms and is selected so the fan will see between 20 mA and 27 mA of average DC current. The current value needed is determined by the fan manufacture specifications. Thus, LED circuit module 360 may be designed to supply a particular voltage to fan 372, or fan 372 may be selected such that the fan will accommodate the voltage supplied to LEDs 370.

Filter 78 may also include a number of capacitors that ensure a constant or acceptable voltage is supplied to fan 372 while a voltage is intermittently and alternately supplied to banks B1-B6 of LEDs 370 by IC 362. Capacitors C1-C4 may be placed within fan 372 and integrally formed as part of a single unit, or alternatively, may be placed outside fan 372 and positioned elsewhere within LED circuit module 360, or within circuitry 61, such as when a size of the capacitors is too large to be accommodated within a housing of the fan. In an embodiment, filter 78 may include four capacitors, C1-C4, that each have a capacitance in a range of about 12-25 microfarads, and are connected in parallel with resistor R1 and fan 372. Because LEDs 370 are not all on at a same time, and fan 372 draws its power from only a portion or bank of the LEDs, fan 372 could, undesirably, receive only intermittent power and thus rapidly switch on and off as IC 362 alternately supplied power to banks B1-B6 of LEDs 370. Providing capacitors as part of filter 78 allows an electrical charge to be stored in the capacitors by drawing electrical current from a bank of LEDs when the bank of LEDs is receiving a voltage from IC 362. Then, when the bank of LEDs to which fan 372 is coupled is not receiving power from IC 362, the capacitors may release a portion of the stored charge to fan 372, such that fan 372 has a constant or sufficient voltage supply so that the fan may operate uninterrupted and continuously conduct heat from the array of LEDs 370 while IC 362 performs its bank switching.

Providing capacitors as part of filter 78 also allows a stable voltage to be provided to fan 372 by eliminating undesired ripple effects within LED circuit module 360. A ripple effect is the small unwanted residual periodic variation of the DC output of IC 362 that results from the input of an AC power source at inputs 64 and 66. The ripple effect is due to an incomplete suppression of the alternating waveform within IC 362. Thus the cycling of LED banks B1-B6 from the alternating voltage supply from IC 362 may cause a ripple effect from the cycling of banks B1-B6 and the turning on and off of LEDs 370. The presence of some ripple effect will not adversely affect operation of fan 372, and the fan will continue to operate in normal ranges. However, excessive ripples will decrease performance of fan 372, thereby reducing both an ability of the fan to transfer heat away from LEDs 370 and reducing an overall life of fan. As described above, inclusion of capacitors within filter 78 between fan 372 and a bank of LEDs serves to maintain a stable voltage, which eliminates excessive ripple effect and improves fan performance and increases fan lifetime.

FIG. 40 also shows additional circuitry 61 that may optionally be coupled to LED circuit module 360 and fan 372. Circuitry 61 may comprise a number of optional resistors, capacitors, diodes, and other devices according to the function and design of a final LED device. In an embodiment, circuitry 61 comprises a thermal switch or thermocouple 380. Thermal switch 380 operates as a cut off switch that will stop operation of LED circuit module 360 if too much heat accumulates within the LED device and threatens to overheat and or damage LEDs 370 or other components of the LED device. For example, if fan 372 breaks or ceases operation and the LED device begins to accumulate dangerous levels of heat, then thermal switch 380 will respond to the increased temperature of the LED device by stopping IC 362 from powering LEDs 370 such that excess heat dissipates and LED circuit module 360 is not damaged.

FIG. 40 further shows a WiFi module or interface 384 included as part of circuitry 61. WiFi module 384 is coupled to AC inputs 64 and 66 as well as to IC 362. In an embodiment, WiFi module 384 may include a WiFi module from Microchip (Roving Networks), part number RN-717. This WiFi module uses a separate microcontroller that may be programmed to interface with a WiFi home system or any other WiFi system. However, other WiFi modules from this and other manufacturers are sufficient for this and other embodiments. WiFi module 384 may be removably attachable to circuitry 61 such that the WiFi module is optionally attached, for example, by being snapped into place. WiFi module 384 can advantageously provide dimming functionality to LEDs 370 by controlling or providing input signals to IC 362 that allow for direct access to LEDs 370 through the WiFi interface. The WiFi interface can be accessed and controlled by a user through a computer, a portable handheld electronics device such as a phone or tablet, and through other suitable devices, thereby eliminating a need for dimmer modules previously used in the art.

While WiFi or radio connections have been previously put into lights, conventional lights with WiFi connections have included a total size or volume that was too large to fit within standard size ceiling J-Boxes. For example, in the Unites States a standard round ceiling J-Box includes a diameter in a range of about 5.0-8.44 centimeters (cm) (or about 2.0-3.375 inches) and a depth of about 2.5-6.875 cm (or about 1.0-2.75 inches) for a total interior volume of about 78-490 cubic centimeters (or 4.0-31.3 cubic inches). Thus, conventional lighting devices with WiFi control were suitable for applications involving can lighting, but had volumes that were prohibitive of use in smaller applications such as use in standard J-boxes as described above. To the contrary, some embodiments of disclosed LED circuit modules 360, circuitry 61 including WiFi module 384, and fan 372, taken together, are small enough to fit in a standard sized junction box while emitting as much light as would be emitted by a conventional 100 Watt incandescent bulb.

FIG. 40 further shows an electrical bridge 386 may optionally be included as part of circuitry 61. Bridge 386 may be coupled between inputs 64 and 66 and LED module circuit 360 to convert the alternating current (AC) power source to a direct current (DC) power source. Bridge 386 may comprise four diodes configured in a bridge configuration. Bridge 386 may be sized to meet the current requirements of the designed load, which in an embodiment, can be about 12-15 Watts. In another particular embodiment, a 500 mA part is used, which exceeds the lower required 90 mA and 125 mA.

Figure 41:
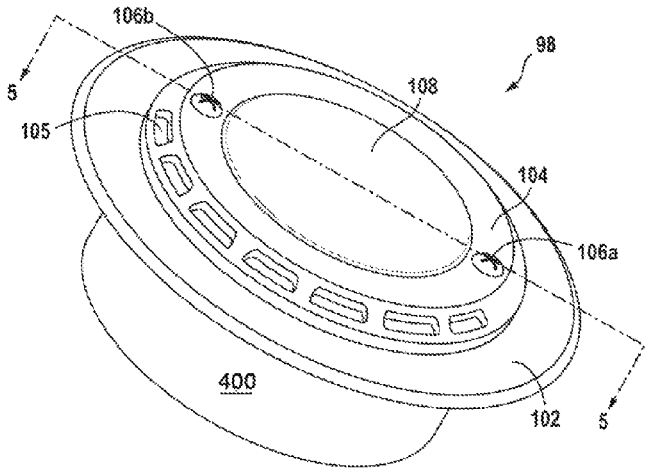
FIG. 41 is a perspective view of an embodiment of an LED device comprising a housing.

FIG. 41 shows a perspective view of LED device 98 comprising circuitry 61 and circuit module 360 described above with respect to FIG. 40 disposed within a standard sized ceiling J-Box 400. A face plate 102 and a base plate 104 comprising vents 105 are disposed over and connected to J-Box 400 with screws 106. A lens 108 is attached to base plate 104 and comprises a translucent material that allows passage of light generated by LEDs 370 to pass through the lens while the lens protects LEDs 370. Vents 105 in base plate 104 increase airflow and permit fan 372 to circulate air around LEDs 370 to cool LED circuit module 360 and LED device 98. By building LED circuit module 360 and circuitry 61 with a volume less than a volume of J-Box 400, LED circuit module 360 may be installed in desired lighting applications by being disposed within J-Box 400 rather than being housed within larger more expensive can lighting that requires additional effort, time, and expense for installation. By installing LED circuit module 360 in J-Box 400 instead of in a can lighting fixture, LED circuit module 360 may be packaged to be much lighter than can lighting and also avoid direct exposure to higher attic temperatures, being instead exposed to cooler temperatures of a room the LED device is lighting, thereby improving thermal performance.

While FIG. 41 shows only a single LED device 98 comprising J-Box 400, a number of LED devices 98 may be electrically connected in series or parallel to form a number of interconnected lighting devices, or a "daisy chain" of LED devices. Interconnected LED devices 98 may be used for lighting rooms and areas requiring more than a single unit and may operate as part of a larger lighting system.

Figure 42:
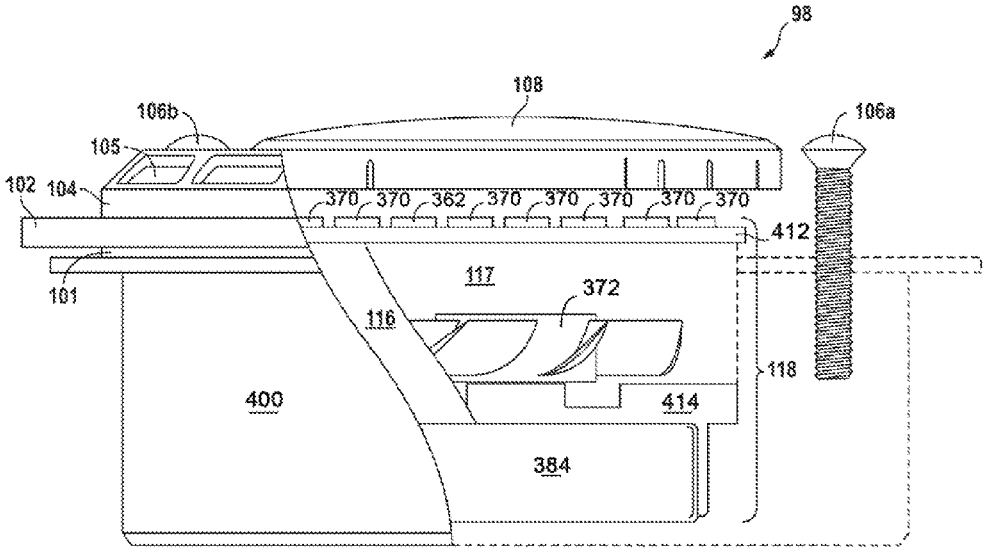
FIG. 42 in a cut away cross-sectional view of the embodiment of the LED device of FIGS. 41.

FIG. 42 shows a cross-sectional view of LED device 98 taken along section line 5-5 shown in FIG. 41. The left side of FIG. 5 shows elements disposed at the exterior of LED device 98 that were shown previously in FIG. 4, such as J-Box 400, face plate 102, base plate 104, screw 106, and lens 108. FIG. 5 further shows a flash mount insulator 101 disposed between J-Box 400 and both face plate 102 and base plate 104. FIG. 5 further shows a cut-away view of LED device 98 by removal of a portion of J-Box 400, flash mount insulator 101, face plate 102, and base plate 104 to reveal interior elements of LED device 98. The exterior elements of LED device 98 shown on the left side of FIG. 5 are removed from the right side of FIG. 5 to show features disposed within the LED device and internal to the exterior elements. For example, FIG. 5 shows LEDs 370 and IC 362 are mounted to a substrate 412 that may be disposed within J-Box 400, over fan 372, over WiFi module 384, and below lens 108. Thus, light emitted from LEDs 370 can pass unobstructed through lens 108.

FIG. 42 also shows a shroud cover or housing base 414 disposed within J-Box 400. Housing base 414 may be made of plastic, metal, fiberglass, ceramic, composite material, or other suitable material that provides a structural base to which fan 71 and WiFi module 84 may be connected. A printed circuit board (PCB) containing circuitry 61 may also be coupled or mounted to housing base 414 below fan 372.

LED device 98 further comprises a fan shroud or housing 116 that may be made of plastic, metal, fiberglass, ceramic, composite material, or other suitable material. Fan shroud or housing 116 is coupled to, and extends between, perimeter portions of substrate 412 and housing base 414. Housing 116 is disposed around fan 372 and forms a space or area 117 in which the fan can circulate air to cool LEDs 370 and LED device 98. Taken together, substrate 412 comprising IC 362 and LEDs 370, fan 372, housing base 414, and housing 116 form a module 118 that may have a height less than a height of J-Box 400.

Figure 43:
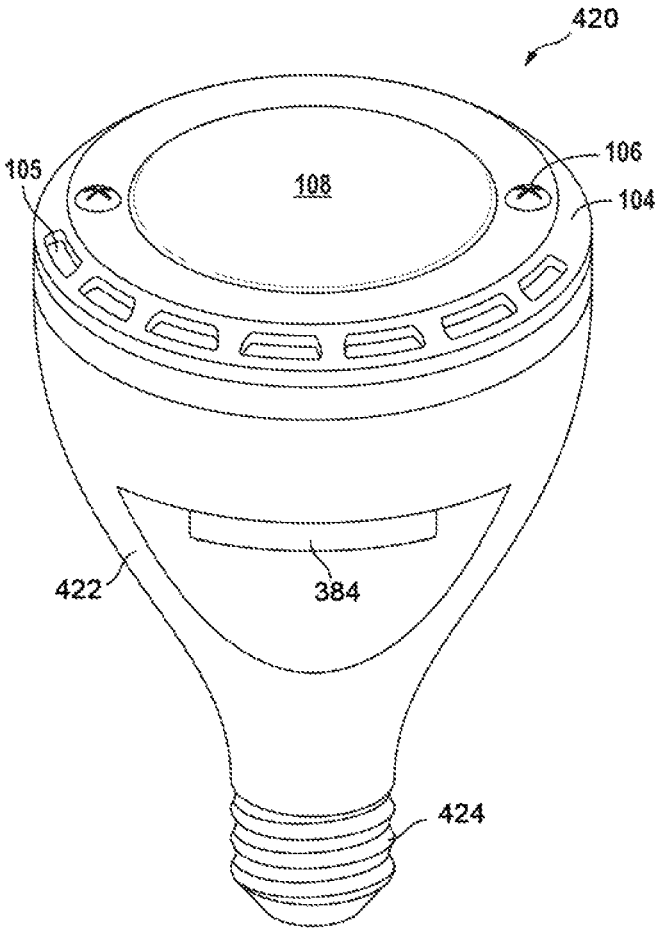
FIG. 43 is a perspective view of another embodiment of an LED device comprising a housing.

FIG. 43 shows a perspective view of an LED device 420 that is similar to LED device 98 shown in FIG. 41. Like LED device 98, LED device 420 may comprise circuit module 360, circuitry 61, and fan 372, disposed within a standard sized housing 122. Housing 422 may be made of plastic, metal, fiberglass, ceramic, composite material, or other suitable material. Housing 422 may contain or surround module 118, the module having a height less than a height of J-Box 400. Housing 422 may be larger than, or enclose an area greater than, the area enclosed by housing 98 to match a shape, contour, or form factor or standard shaped or commercially available product, such as a Par 30 bulb. Because module 118 is smaller than J-Box 400 and housing 422, the same module may be used in multiple different housings without modifying the shape and layout of the module. By using a single module design within multiple housings, greater efficiencies and lower costs may be achieved. Additional space created between module 118 and housing 422 may be shaped and used for air circulation and LED cooling. In an embodiment, housing 422 is shaped to expose at least a portion of WiFi module 384 at an exterior of LED device 420 for easy access that enables the optional addition and removal of the WiFi module.

FIG. 43 further shows LED device 420 may include a socket fitting 424 attached to an end of LED device 420 opposite lens 108. Socket fitting 424 may be made of metal or other conductive material or combination of materials. Socket fitting 424 may be threaded to be removably attached LED device 420 to a standard light socket configured to receive conventional light bulbs and provide a voltage or electrical power supply to circuit module 360.

Similar to FIGS. 41 and 42, LED device 420 of FIG. 43 includes a base plate 104 comprising vents 105, screws 106, and lens 108. Base plate 104 is disposed over and may be connected to housing 422 opposite socket fitting 424 with screws 106. A lens 108 may be coupled to base plate 104 and housing 422 and comprises a translucent material that allows passage of light generated by LEDs 370 while protecting LEDs 370. Vents 105 in base plate 104 increase airflow and permit fan 372 to circulate air around LEDs 370 to cool LED circuit module 360 and LED device 420.

While FIG. 43 shows only a single LED device 420, a number of LED devices may be electrically connected in series or parallel to form a number of interconnected lighting devices, or a "daisy chain" of LED devices 420. Interconnected LED devices 420 may be used for lighting rooms and areas requiring more than a single unit and may operate as part of a larger lighting system.

It will be understood that implementations are not limited to the specific components disclosed herein, as virtually any components consistent with the intended operation of a method and/or system implementation for LED cooling systems may be utilized. Accordingly, for example, although particular fans, heat sinks, fan housings, LEDs, covers, and the like may be disclosed, such components may comprise any shape, size, style, type, model, version, class, grade, measurement, concentration, material, weight, quantity, and/or the like consistent with the intended operation of a method and/or system implementation for a LED cooling system may be used.

In places where the description above refers to particular implementations of an LED cooling system, it should be readily apparent that a number of modifications may be made without departing from the spirit thereof and that these implementations may be applied to other LED cooling system or assemblies. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A light emitting diode (LED) lighting system, comprising:

one or more LEDs;

a heat sink coupled to the one or more LEDs, the heat sink comprising an outer periphery, a platform, two sink walls, and two air exhaust openings extending through the platform, each air exhaust opening positioned between a different sink wall of the two sink walls and the platform;

a fan housing coupled to the platform of the heat sink opposite the one or more LEDs, the fan housing comprising two opposing end walls each positioned between a different sink wall of the two sink walls and the outer periphery of the heat sink, two opposing sidewalls positioned between the two end walls, two opposing dividing walls coupled to the two opposing end walls and each comprising a terminating end aligned with and adjacent to a different one of the two sink walls, two outer openings positioned between a different end wall of the two end walls and a different dividing wall of the two dividing walls, a fan housing aperture within the fan housing positioned between the two dividing walls, and a cover coupled to the end wall opposite the heat sink;

a fan coupled to the fan housing and positioned at least partially within the fan housing aperture, wherein airflow enters the fan housing through the two outer openings, passes through the fan housing aperture to interface the heat sink, and exits through the two air exhaust openings responsive to activation of the fan.

2. The LED lighting system of claim 1, wherein the fan housing includes a height in a range between 2.5-6.875 centimeters and includes a volume small enough to be housed within a standard single gang electrical junction box.

3. The LED lighting system of claim 2, wherein the heat sink is configured to mount to a flat surface and the end walls, the sidewalls, and the dividing walls of the fan housing are integral with one another.

4. The LED lighting system of claim 3, wherein the heat sink further comprises an outer wall at the outer periphery, a heat sink channel formed between the outer wall and each of the heat sink walls, and a plurality of air intake openings extending through the outer wall.

5. The LED lighting system of claim 4, wherein the plurality of air intake openings are positioned within an angled portion of the outer wall and the heat sink further comprises a plurality of arced ribs extending from the platform toward the fan housing.

6. The LED lighting system of claim 5, further comprising a bulb-like housing coupled to the heat sink such that the fan housing is housed within the bulb-like housing, the bulb like housing comprising an open first end coupled to the heat sink and a second end coupled to a socket fitting operably coupled to the one or more LEDs and the fan, wherein, responsive to activation of the fan, air flows into the LED light system through the air intake openings, through the two outer openings, through the fan housing aperture, and out the air exhaust openings, each air exhaust opening being separated from the air intake openings by at least the respective sink wall.

7. The LED lighting system of claim 3, further comprising a mounting ring removably coupled to the heat sink, the mounting ring comprising one or more screw holes positioned to align with one or more screw mounts on a standard electrical junction box such that when the mounting ring is coupled to the standard electrical junction box, the fan housing is positioned within the standard electrical junction box and at least a portion of the mounting ring is adjacent a flat surface to which the standard electrical junction box is mounted.

8. The LED lighting system of claim 7, further comprising:

a plurality of spacing tabs on an inner surface of the sink between the heat sink and the mounting ring;

an air intake opening formed between an outer surface of the mounting ring and the inner surface of the heat sink, wherein, responsive to activation of the fan, air flows into the LED light system through the air intake opening, through the two outer openings, through the fan housing aperture, and out the air exhaust openings.

9. The LED lighting system of claim 1, wherein the lighting system further comprises a semiconductor chip comprising an input coupled to an AC power supply and further comprising a plurality of DC power outputs, wherein the one or more LEDs comprises a plurality of banks of LEDs coupled to the plurality of DC power outputs, and wherein the fan is further coupled in parallel with a first of the plurality of banks of LEDs.

10. A light emitting diode (LED) lighting system, comprising:

one or more LEDs;

a heat sink coupled to the one or more LEDs, the heat sink comprising a platform, a sink wall, and an air exhaust opening heat sink;

a mounting ring coupled to the heat sink opposite the one or more LEDs, the mounting ring comprising one or more screw holes positioned to mount the LED lighting system to an electrical junction box mounted to a flat surface;

a fan housing coupled to the platform of the heat sink opposite the one or more LEDs and sized to fit within a single gang electrical junction box, the fan housing comprising an end wall, a dividing wall coupled to the end wall and comprising a terminating end aligned with and adjacent to the sink wall, an outer opening positioned between the end wall and the dividing wall, a fan housing aperture within the fan housing, and a cover opposite the heat sink;

a fan coupled to the fan housing and positioned at least partially within the fan housing aperture, wherein, responsive to activation of the fan, airflow enters the fan housing through the outer opening, passes through the fan housing aperture to interface with the heat sink, and the exits through the air exhaust opening of the heat sink.

11. The LED lighting system of claim 10, wherein:

the sink wall comprises two sink walls;

the air exhaust openings comprise two air exhaust openings extending through the platform, each air exhaust opening positioned between a different sink wall and the platform;

the end wall of the fan housing comprises two opposing end walls, the fan housing further comprising two opposing sidewalls positioned between the two end walls;

the dividing wall of the fan housing comprises two opposing dividing walls each comprising a terminating end aligned with and adjacent to a different one of the two sink walls, the fan housing aperture being positioned between the two dividing walls; and the outer opening comprises two outer openings positioned between a different end wall of the two end walls and a different dividing wall of the two dividing walls.

12. The LED lighting system of claim 11, wherein the dividing walls, the end walls, and the sidewalls of the fan housing are integral with one another, and wherein the heat sink further comprises an outer wall at an outer periphery, a heat sink channel formed between the outer wall and each of the heat sink walls, one or more screw holes, and a plurality of air intake openings extending through the outer wall.

13. The LED lighting system of claim 12, wherein the plurality of air intake openings are positioned within an angled portion of the outer wall and the heat sink further comprises a plurality of arced ribs extending from the platform toward the fan housing.

14. The LED lighting system of claim 13, further comprising a bulb-like housing coupled to the mounting ring such that the fan housing is housed within the bulb-like housing, the bulb like housing comprising an open end coupled to the heat sink and a closed end coupled to a socket fitting operably coupled to the one or more LEDs and the fan, wherein, responsive to activation of the fan, air flows into the LED light system through the air intake openings, through the two outer openings, through the fan housing aperture, and out the air exhaust openings, each air exhaust opening being separated from the air intake openings by at least the respective sink wall.

15. The LED lighting system of claim 12, further comprising a mounting ring removably coupled to the heat sink, the mounting box comprising one or more screw holes positioned to align with one or more screw mounts on a standard electrical junction box such that when the mounting ring is coupled to the standard electrical junction box, the fan housing is positioned within the standard electrical junction box and at least a portion of the mounting ring is adjacent a flat wall to which the standard electrical junction box is mounted.

16. The LED lighting system of claim 15, further comprising:

a plurality of spacing tabs on an inner surface of the sink between the heat sink and the mounting ring; and an air intake opening formed between an outer surface of the mounting ring and the inner surface of the heat sink, wherein, responsive to activation of the fan, air flows into the LED light system through the air intake opening, through the two outer openings, through the fan housing aperture, and out the air exhaust openings.

17. The LED lighting system of claim 10, wherein the lighting system further comprises a semiconductor chip comprising an input coupled to an AC power supply and further comprising a plurality of DC power outputs, wherein the one or more LEDs comprises a plurality of banks of LEDs coupled to the plurality of DC power outputs, and wherein the far is further coupled in parallel with a first of the plurality of banks of LEDs.

18. A method of mounting a light emitting diode (LED) lighting system to a flat surface, comprising:

inserting a fan housing of the LED lighting system into an electrical junction box adjacent the flat surface, the fan housing comprising an end wall, a dividing wall, an outer opening positioned between the end wall and the dividing wall, and a fan housing aperture within the fan housing with a fan mounted therein; and coupling a heat sink of the LED lighting system to the electrical junction box, the heat sink being coupled to the fan housing and comprising a platform adjacent the fan housing, a sink wall adjacent the dividing wall, and an air exhaust positioned on a side of the dividing wall opposite the outer opening such that, responsive to activation of the fan, air flows into the housing through outer opening, through the fan housing aperture, and out of the LED lighting system through the air exhaust opening.

19. The method of claim 18, further comprising coupling a mounting ring to the electrical junction box.

20. The method of claim 19, wherein coupling the heat sink to the electrical junction box comprises coupling the heat sink to the mounting ring coupled to the electrical junction box.

21. The method of claim 18, further comprising:

transmitting AC power to a semiconductor chip of the LED lighting system;

transmitting DC power from the semiconductor chip to a first bank of LEDs and not a second bank of LEDs;

transmitting DC power from the semiconductor chip to the second bank of LEDs and not the first bank of LEDs; and operating the fan at a speed proportional to a brightness of the first and second banks of LEDs.

22. The method of claim 20, further comprising: operating the fan by transmitting DC power from the semiconductor chip through the first bank of LEDs to the fan.

23. The method of claim 20, further comprising operating the fan by transmitting DC power from the first bank of LEDs through a filter to the fan.

* * * * *